US010794336B2

(12) United States Patent
Kuske et al.

(10) Patent No.: US 10,794,336 B2
(45) Date of Patent: Oct. 6, 2020

(54) METHODS AND SYSTEMS FOR AN EXHAUST GAS RECIRCULATION COOLER

(71) Applicant: Ford Global Technologies, LLC, Dearborn, MI (US)

(72) Inventors: Andreas Kuske, Geulle (NL); Hans Guenter Quix, Herzogenrath (DE); Franz Arnd Sommerhoff, Aachen (DE); Joerg Kemmerling, Monschau (DE); Vanco Smiljanovski, Bedburg (DE); Helmut Matthias Kindl, Aachen (DE); Hanno Friederichs, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 323 days.

(21) Appl. No.: 15/487,289

(22) Filed: Apr. 13, 2017

(65) Prior Publication Data

US 2017/0298874 A1 Oct. 19, 2017

(30) Foreign Application Priority Data

Apr. 14, 2016 (DE) ..... 10 2016 206 236
Apr. 14, 2016 (DE) ..... 10 2016 206 239

(51) Int. Cl.

| | |
|---|---|
| ***F02M 26/24*** | (2016.01) |
| ***F02M 26/29*** | (2016.01) |
| ***F02M 26/35*** | (2016.01) |
| ***F01N 3/04*** | (2006.01) |
| ***F01P 3/20*** | (2006.01) |
| ***F01P 7/16*** | (2006.01) |

(52) U.S. Cl.

CPC ..... *F02M 26/24* (2016.02); *F01N 3/043* (2013.01); *F01P 3/20* (2013.01); *F01P 7/165* (2013.01); *F02M 26/29* (2016.02); *F02M 26/35* (2016.02)

(58) Field of Classification Search

CPC ..... F02M 26/24; F02M 26/29; F02M 26/35; F02M 26/32; F02M 26/28; F01N 3/043; F01P 3/20; F01P 7/165

USPC ..... 123/568.12

See application file for complete search history.

(56) References Cited

U.S. PATENT DOCUMENTS 5,931,131 A * 8/1999 Hackett ..... F02B 47/08 123/195 C
6,367,256 B1 * 4/2002 McKee ..... F02M 26/05 123/568.12

(Continued)

FOREIGN PATENT DOCUMENTS

DE 69817294 T2 6/2004
DE 102010048255 A1 6/2011

(Continued)

*Primary Examiner* — Hung Q Nguyen
*Assistant Examiner* — Susan E Scharpf
(74) *Attorney, Agent, or Firm* — Geoffrey Brumbaugh; McCoy Russell LLP

(57) ABSTRACT

Methods and systems are provided for an EGR cooler having first and second coolant jackets fluidly coupled to first and second coolant systems, respectively. In one example, the first and second coolant jackets are hermetically sealed from one another. Furthermore, the second coolant jacket protrudes into a portion of an exhaust gas passage directly downstream of an exhaust aftertreatment device.

14 Claims, 8 Drawing Sheets

(56) References Cited

U.S. PATENT DOCUMENTS 6,904,898 B1 * 6/2005 Sahlen ..... F02M 26/50 123/568.12
9,239,031 B2 * 1/2016 Huesges ..... F02M 26/69
9,512,753 B2 * 12/2016 Han ..... F01M 5/001
9,611,818 B2 4/2017 Yang et al.
2001/0052341 A1 * 12/2001 Sasaki ..... F01N 3/2006 123/568.12
2001/0054416 A1 * 12/2001 Yoshizaki ..... F02D 41/0057 123/568.12
2003/0150406 A1 * 8/2003 Takagi ..... F01P 7/167 123/41.1
2004/0163378 A1 * 8/2004 Sasaki ..... F02D 41/0057 60/284
2005/0021218 A1 * 1/2005 Bhargava ..... F02D 41/0007 701/108
2006/0086089 A1 * 4/2006 Ge ..... F02B 29/0418 60/599
2006/0112679 A1 * 6/2006 Kojima ..... F02D 41/0055 60/278
2006/0185364 A1 * 8/2006 Chalgren ..... F02B 29/0493 60/599
2006/0185626 A1 * 8/2006 Allen ..... F01P 7/048 123/41.12
2006/0201164 A1 * 9/2006 Fickel ..... F02M 21/06 62/50.2
2006/0207245 A1 * 9/2006 Yamaguchi ..... F01N 5/02 60/320
2007/0062490 A1 * 3/2007 Yang ..... F02M 31/08 123/435
2007/0089716 A1 * 4/2007 Saele ..... F01N 3/0205 123/568.12
2007/0131207 A1 * 6/2007 Nakamura ..... F02M 26/50 123/568.12
2007/0272173 A1 * 11/2007 Reckels ..... F01P 7/167 123/41.11
2008/0115747 A1 * 5/2008 Snyder ..... F01P 3/20 123/41.31
2008/0156302 A1 * 7/2008 El Tahry ..... F02D 41/0072 123/568.11
2008/0264609 A1 * 10/2008 Lutz ..... F28D 7/0091 165/104.19
2008/0295514 A1 * 12/2008 Ono ..... F01N 3/035 60/602
2009/0038308 A1 * 2/2009 Nagae ..... F01N 3/035 60/602
2009/0308071 A1 * 12/2009 Yamashita ..... F02B 29/0418 60/602
2011/0023797 A1 * 2/2011 Lenz ..... F01P 3/02 123/41.29
2011/0107983 A1 * 5/2011 Magro ..... F01N 3/04 123/41.1
2012/0017575 A1 * 1/2012 Sloss ..... F01N 5/02 60/320
2012/0017879 A1 * 1/2012 Wu ..... F02M 26/07 123/568.11
2012/0036848 A1 * 2/2012 Quix ..... F02B 37/18 60/605.2
2013/0025577 A1 * 1/2013 Huesges ..... F02M 26/69 123/568.12
2015/0040875 A1 * 2/2015 Han ..... F01M 5/001 123/568.12

FOREIGN PATENT DOCUMENTS

DE 102012219811 A1 4/2014
DE 202016100731 U1 4/2016

* cited by examiner

METHODS AND SYSTEMS FOR AN EXHAUST GAS RECIRCULATION COOLER

CROSS REFERENCE TO RELATED APPLICATION

The present application claims priority to German Patent Application No. 102016206239.5, filed on Apr. 14, 2016, and to German Patent Application No. 102016206236.0, filed on Apr. 14, 2016. The entire contents of the above-referenced applications are hereby incorporated by reference in their entirety for all purposes.

FIELD

The present description relates generally to an exhaust gas recirculation cooler having two or more coolant jackets.

BACKGROUND/SUMMARY

Internal combustion engines are being fitted increasingly frequently with a forced-induction system, wherein forced induction is primarily a method for boosting power, in which the charge air needed for the combustion process in the engine is compressed, thus allowing a larger mass of charge air to be fed to each cylinder in each operating cycle. It is thereby possible to increase the fuel mass and hence the mean pressure.

Forced induction is a suitable means of increasing the power of an internal combustion engine while keeping the displacement the same or reducing the displacement for the same power. In either case, forced induction leads to an increase in power to unit volume and to a more favorable power to weight ratio. If the displacement is reduced, it is possible, under the same vehicle boundary conditions, to shift the load population toward higher loads, at which specific fuel consumption is lower. Thus, forced induction of an internal combustion engine assists efforts to minimize fuel consumption and improve the efficiency of the internal combustion engine.

Through suitable design of the transmission, it is additionally possible to achieve "down speeding", whereby a lower specific fuel consumption is likewise achieved. In down speeding, use is made of the fact that specific fuel consumption is normally lower at low engine speeds, especially at higher loads.

With careful design of the forced induction system, it is also possible to achieve advantages in terms of the exhaust emissions. Thus, by means of suitable forced induction, it is possible to reduce nitrogen oxide emissions without sacrificing efficiency in diesel engines, for example. At the same time, it is possible to exert a positive effect on hydrocarbon emissions. Emissions of carbon dioxide, which are directly correlated with fuel consumption, likewise decrease with decreasing fuel consumption.

In order to comply with future limits on pollutant emissions, however, further measures are desired. Among considerations at the center of development work is the reduction of nitrogen oxide emissions, which are of great significance, especially with diesel engines. Since the formation of nitrogen oxides occurs not only under an excess of air but also high temperatures, one concept for reducing nitrogen oxide emissions is to develop combustion processes with lower combustion temperatures.

In this context, exhaust gas recirculation (EGR), i.e. the recirculation of combustion gases from the outlet side to the inlet side, is expedient, it being possible with this method to significantly reduce nitrogen oxide emissions as the exhaust gas recirculation rate increases. Here, the exhaust gas recirculation rate $x_{EGR}$ is $x_{EGR}=m_{EGR}/(m_{EGR}+m_{fresh\ air})$, where $m_{EGR}$ denotes the mass of recirculated exhaust gas and $m_{fresh\ air}$ denotes the fresh air supplied. The oxygen supplied by way of exhaust gas recirculation must be taken into account, where appropriate.

To achieve a significant reduction in nitrogen oxide emissions, high exhaust gas recirculation rates may be desired, and these may be of the order of $x_{EGR}\approx 60\%$ to 70% and above. Such high recirculation rates may necessitate cooling of the exhaust gas to be recirculated, thereby lowering the temperature of the exhaust gas and increasing the density of the exhaust gas, thus enabling a larger exhaust gas mass to be recirculated. Consequently, an exhaust gas recirculation system is normally fitted with a cooler. The exhaust gas recirculation system of the internal combustion engine which forms the subject matter of the present disclosure also has a cooler arranged in the recirculation line, herein referred to as an EGR cooler, which has a core that conducts coolant and serves to transfer heat between the exhaust gas and the coolant.

Problems can arise when introducing the recirculated exhaust gas into the intake system if the temperature of the recirculated hot exhaust gas falls and condensate forms.

On the one hand, condensate can form if the recirculated hot exhaust gas comes into contact and is mixed with cool fresh air in the intake system. The exhaust gas cools down, whereas the temperature of the fresh air is raised. The temperature of the mixture of fresh air and recirculated exhaust gas (e.g., the temperature of the combustion air), is below the exhaust gas temperature of the recirculated exhaust gas. In the course of the cooling of the exhaust gas, liquids, especially water, which were previously contained in gaseous form in the exhaust gas or in the combustion air, can condense out if the dew point of one component of the gaseous combustion air flow is undershot. Condensate forms in the free combustion air flow, and impurities in the combustion air frequently form the starting point for the formation of condensate droplets.

On the other hand, condensate can form when the recirculated hot exhaust gas or the combustion air meets the inner wall of the intake system since the wall temperature is below the dew point of the relevant gaseous components during some engine operating conditions.

Condensate and condensate droplets are unwanted and may lead to increased noise emissions in the intake system, possibly leading to degradation in the rotor blades of a compressor impeller, arranged in the intake system, of a charger or exhaust turbocharger. The latter phenomenon (e.g., the degradation) is associated with a reduction in the efficiency of the compressor.

An EGR cooler can also be expedient or helpful as regards the problems with condensate formation described above. Cooling the exhaust gas to be recirculated in the course of recirculation has the advantageous effect that condensate does not start to form only in the intake system but is already forming during recirculation and can be removed in the course of recirculation.

The disadvantage with the previous examples of EGR coolers is that, by virtue of the principle involved, the exhaust gas energy (e.g., the heat removed from the exhaust gas in the cooler by means of coolant) is only available and usable if exhaust gas is recirculated. If the exhaust gas recirculation system is deactivated, so that no exhaust gas is recirculated, the exhaust gas energy of the hot exhaust gas remains unused. If this exhaust gas energy could be used, it would be possible to achieve further advantages in terms of efficiency in the internal combustion engine.

For example, the energy of the hot exhaust gas could be used to reduce the friction power and hence the fuel consumption of the internal combustion engine. In this context, rapid heating of the engine oil by means of exhaust gas heat could be expedient, especially after a cold start. Rapid heating of the engine oil during the warm-up phase of the internal combustion engine ensures a correspondingly rapid decrease in the viscosity of the oil and hence a reduction in friction or friction power, especially in the bearings supplied with oil, e.g. the bearings of the crankshaft.

The oil could be actively heated by means of a heating device, for example. For this purpose, a coolant-operated oil cooler can be diverted from its normal purpose in the warm-up phase and used to heat the oil.

In principle, rapid heating of the engine oil to reduce friction power can also be promoted by rapid heating of the internal combustion engine itself, which, in turn, is assisted, i.e. accelerated, by removing as little heat as possible from the internal combustion engine during the warm-up phase.

To this extent, it may also be expedient, in the case of a liquid-cooled internal combustion engine, to supply heat to the coolant of the engine cooling system, particularly in the warm-up phase or after a cold start. The exhaust gas energy may be used to heat the coolant in the engine cooling system.

Given what has been stated, it is an object of the present disclosure to provide a forced-induction internal combustion engine in accordance with the preamble of claim 1 in which the exhaust gas energy can be used more effectively than in previous exhaust systems and which is further improved as regards efficiency.

It is another partial object of the present disclosure to indicate a method for operating an internal combustion engine of this kind.

The first partial object is achieved by a forced-induction internal combustion engine having at least one cylinder, an intake system for supplying the at least one cylinder with charge air, an exhaust system for discharging the exhaust gases, and an exhaust gas recirculation system, which has a recirculation line which, while forming a junction, branches off from the exhaust system and opens into the intake system, wherein a cooler is provided in the recirculation line, which cooler has a core, which conducts coolant, is incorporated into a first coolant circuit and serves to transfer heat between the exhaust gas and the coolant, wherein the cooler projects into the exhaust system in the region of the core, and at least one coolant jacket, which conducts coolant, is provided in the cooler, said jacket being arranged between the core conducting coolant and the exhaust system conducting exhaust gas and being incorporated into a second coolant circuit, wherein, to form the second coolant circuit, the at least one coolant jacket has a discharge line for discharging the coolant and a supply line for supplying the coolant.

In the case of the internal combustion engine according to the present disclosure, the cooler projects into the exhaust system in the region of the core, with the result that there is a flow of hot exhaust gas around at least some area or areas of the core conducting coolant, or that this/these are subjected to hot exhaust gas, even when the exhaust gas recirculation system is deactivated and no exhaust gas at all is being recirculated. This has the advantageous effect that the exhaust gas energy of the hot exhaust gas can be used, i.e. is usable, at any time.

In the warm-up phase or after a cold start, for example, the exhaust gas energy can be used to heat the engine oil of the internal combustion engine and hence reduce the friction power of the internal combustion engine. In the case of a liquid-cooled internal combustion engine, the exhaust gas energy can be used to heat the coolant for the engine cooling system and hence speed up the heating of the internal combustion engine. Both measures improve or increase the efficiency of the internal combustion engine.

In this connection, it is also desired to take into account the fact that it is not desired for exhaust gas to be recirculated after a cold start of the internal combustion engine since condensate would unavoidably form in a particularly large quantity in the still-cold intake system when the recirculated exhaust gas is introduced. Consequently, current systems may not utilize the exhaust gas energy of the hot exhaust gas, particularly after a cold start, even though it is precisely after a cold start of the internal combustion engine that there is a desire to selectively heat the engine oil or the internal combustion engine.

According to the present disclosure, in contrast, it is possible to use the exhaust gas energy of the hot exhaust gas even when the exhaust gas recirculation system is deactivated, this being possible by virtue of the arrangement according to the EGR cooler in the exhaust system of the internal combustion engine described herein. Even when the exhaust gas recirculation system is deactivated, heat can be transferred from the exhaust gas to the coolant in the core, wherein the coolant flowing or circulating through the cooler dissipates the heat from the interior of the cooler and feeds it to a predetermined use, thereby increasing the efficiency of the internal combustion engine. Thus, the exhaust gas energy inherent in the exhaust gas in the exhaust gas recirculation system can be used. The coolant-conducting core of the cooler belongs to a first coolant circuit. The first coolant circuit is part of the engine cooling system if the internal combustion engine is fitted with a liquid cooling system.

At least one coolant jacket of a second coolant circuit is arranged in the cooler, between the core conducting coolant and the exhaust system conducting exhaust gas, and this jacket can be either filled with coolant or freed from coolant, i.e. emptied. In the context of the present disclosure, the at least one coolant jacket is to be considered as situated or arranged between the core and the exhaust system if a virtual connecting line, which connects the core to the exhaust system over the shortest distance, passes through the at least one coolant jacket.

The primary function of the at least one coolant jacket is to thermally couple or thermally separate, i.e. decouple, the core, which conducts coolant, and the exhaust system, which conducts exhaust gas.

A coolant-filled coolant jacket serves as a thermal bridge, with the result that heat is or can be transmitted from the exhaust gas to the coolant in the core via the coolant in the coolant jacket. The cooler is activated when the exhaust gas recirculation system is deactivated, with the result that coolant flows or is passed through the core, and the heat absorbed in the core by the coolant of the first coolant circuit can be fed to a predetermined use. During this process, the coolant in the coolant jacket preferably does not circulate in the second coolant circuit but is at rest. The coolant is at rest in the coolant jacket or in the second coolant circuit since it does not serve to transfer heat by means of coolant circulation but serves for heat conduction, namely heat conduction from the exhaust gas to the coolant in the core. However, if there is the risk of overheating of the coolant during this process, which can lead to evaporation of coolant, it may be desired to circulate the coolant in the second coolant circuit to remove, i.e. dissipate, at some other point the heat introduced into the coolant.

A coolant jacket freed from coolant, i.e. at least partially emptied, serves as a thermal barrier, which makes more difficult or prevents heat transfer from the exhaust gas to the coolant in the core. It may be expedient to block or make more difficult the input of heat into the coolant in the core to ensure that no heat is input into the first coolant circuit, e.g. the liquid cooling system of the internal combustion engine. This is appropriate if the liquid cooling system of the internal combustion engine is already highly stressed, e.g. at full load.

The at least one coolant jacket has a discharge line for discharging the coolant and a supply line for supplying the coolant.

The internal combustion engine according to the present disclosure achieves the first object underlying the present disclosure, namely that of providing a forced-induction internal combustion engine, in which the exhaust gas energy can be used more effectively than EGR coolers comprising a single coolant jacket.

Embodiments of the forced-induction internal combustion engine are advantageous in which the first coolant circuit and the second coolant circuit are separated fluidically from one another. In one example, the first and second coolant circuits are hermetically sealed from one another. In other examples, the first and second coolant circuits are selectively fluidly coupled to one another.

Embodiments of the forced-induction internal combustion engine are advantageous in which at least one exhaust turbocharger is provided, which comprises a turbine arranged in the exhaust system and a compressor arranged in the intake system.

In the present case, the exhaust turbocharger used for forced induction is one in which a compressor and a turbine are arranged on the same shaft. The hot exhaust gas flow is fed to the turbine and expands in the turbine, releasing energy, thereby imparting rotation to the shaft. The energy released from the exhaust gas flow to the shaft is used to drive the compressor, which is likewise arranged on the shaft. The compressor delivers and compresses the charge air fed to it, thereby ensuring forced induction of the cylinders. It is advantageous if a charge air cooler is provided in the intake system downstream of the compressor to cool the compressed charge air before it enters the at least one cylinder. The cooler lowers the temperature and thus increases the density of the charge air, and hence the cooler air contributes to better filling of the cylinders, i.e. to a larger air mass. This is the process of compression by cooling.

The advantage of an exhaust turbocharger in comparison, for example, with a mechanical charger is that there is no need for a mechanical link for power transmission between the charger and the internal combustion engine. While a mechanical charger takes the energy needed to drive it directly from the internal combustion engine and therefore reduces the available power and hence has a negative effect on efficiency, the exhaust turbocharger uses the exhaust gas energy of the hot exhaust gases.

In order to be able to counteract a loss of torque at low engine speeds, embodiments of the internal combustion engine are particularly advantageous in which at least two exhaust turbochargers are provided. If, namely, the engine speed is reduced, this leads to a lower exhaust gas mass flow and hence to a lower turbine pressure ratio. This has the result that, toward relatively low engine speeds, the boost pressure ratio likewise decreases, this being equivalent to a loss of torque.

By using a plurality of exhaust turbochargers, e.g. a plurality of exhaust turbochargers connected in series or in parallel, it is possible to make a discernible improvement in the torque characteristic of a forced-induction internal combustion engine.

In this context, embodiments of the forced-induction internal combustion engine are advantageous in which the recirculation line opens into the intake system downstream of the compressor.

In a "high-pressure EGR system", the exhaust gas is introduced into the intake system downstream of the compressor. In order to provide or ensure the pressure gradient needed for recirculation between the exhaust system and the intake system, the exhaust gas is preferably and normally taken from the exhaust system upstream of the associated turbine. High-pressure EGR has the advantage that the exhaust gas does not pass through the compressor and therefore does not have to be subjected to any exhaust gas aftertreatment, e.g. in a particle filter, before recirculation. There is no risk of deposits in the compressor, which change the geometry of the compressor, in particular the flow cross sections, and in this way prejudice the efficiency of the compressor. Condensate may form downstream of the compressor, which also heats the charge air fed to it in the course of compression and in this way prevents or counteracts condensate formation.

In this context, embodiments of the forced-induction internal combustion engine can also be advantageous in which the recirculation line opens into the intake system upstream of the compressor.

During the operation of an internal combustion engine with exhaust turbocharging and simultaneous use of a high-pressure EGR system, there can be a conflict if the recirculated exhaust gas is taken from the exhaust system upstream of the turbine and is no longer available to drive the turbine.

If the exhaust gas recirculation rate is increased, the exhaust gas flow introduced into the turbine simultaneously decreases. The reduced exhaust gas mass flow through the turbine entails a lower turbine pressure ratio, as a result of which the boost pressure ratio likewise decreases, this being equivalent to a lower compressor mass flow. Apart from the decrease in boost pressure, problems can additionally arise in the operation of the compressor in respect of the surge limit. Disadvantages can also arise with the pollutant emissions, e.g. in respect of soot formation in diesel engines during acceleration.

For this reason, there is a demand for concepts which ensure sufficiently high boost pressures with simultaneously high exhaust gas recirculation rates. One approach to a solution is provided by "low-pressure EGR", by means of which exhaust gas which has already flowed through the turbine is fed back into the intake system. For this purpose, the low-pressure EGR system comprises a recirculation line which branches off from the exhaust system downstream of the turbine. The recirculation line preferably opens into the intake system upstream of the compressor in order to be able to achieve the pressure gradient required for recirculation between the exhaust system and the intake system.

To generate the desired pressure gradient, it is also possible to provide a shutoff element in the exhaust system in order to build up the exhaust gas and increase the exhaust gas pressure, and/or to provide a shutoff element in the intake system in order to reduce the pressure upstream of the compressor on the inlet side. Both measures are disadvantageous in terms of energy. In particular, restricting the charge air on the inlet side upstream of the compressor may be disadvantageous in respect of the charging of the internal combustion engine.

The exhaust gas recirculated by means of low-pressure EGR is mixed with fresh air upstream of the compressor. The mixture of fresh air and recirculated exhaust gas produced in this way forms the charge air which is fed to the compressor and compressed, wherein the compressed charge air is preferably cooled downstream of the compressor in a charge air cooler.

Since exhaust gas is passed through the compressor, the exhaust gas is preferably subjected to exhaust gas aftertreatment downstream of the turbine. Low-pressure EGR can also be combined with high-pressure EGR.

For the abovementioned reasons, embodiments of the forced-induction internal combustion engine can be advantageous in which the recirculation line branches off from the exhaust system upstream of the turbine, forming the junction.

Embodiments of the forced-induction internal combustion engine are advantageous in which the turbine of an exhaust turbocharger which is provided has a variable turbine geometry which permits more extensive adaptation to the operation of the internal combustion engine by adjustment of the turbine geometry or of the effective turbine cross section. In this case, adjustable guide vanes for influencing the direction of flow are arranged in the inlet region of the turbine. In contrast to the rotor blades of the revolving rotor, the guide vanes do not rotate with the shaft of the turbine.

If the turbine has a fixed, invariable geometry, the guide vanes are not only stationary but are furthermore arranged fully immovably in the inlet region, i.e. are rigidly fixed, if any guide arrangement is provided at all. In the case of a variable geometry, in contrast, the guide vanes are arranged so as to be stationary but are not completely immovable, being capable of being rotated about their axis, making it possible to influence the incident flow to the rotor blades.

By adjusting the turbine geometry, it is possible to influence the exhaust gas pressure upstream of the turbine and hence the pressure gradient between the exhaust system and the intake system and thus the recirculation rate of the high-pressure EGR system.

Likewise for reasons already mentioned, embodiments of the forced-induction internal combustion engine can be advantageous in which the recirculation line branches off from the exhaust system downstream of the turbine, forming the junction.

Embodiments of the forced-induction internal combustion engine are advantageous in which a container for storing the coolant for the second coolant circuit is provided, which is at least connectable to the at least one coolant jacket of the second coolant circuit via the discharge line and via the supply line.

If the coolant jacket is freed from coolant, i.e. at least partially emptied via the discharge line, the coolant can be stored in the container; it can also be de-aerated, if desired. If the coolant jacket is no longer desired as a thermal barrier or if a coolant jacket filled with coolant is intended to facilitate or permit heat transfer from the exhaust gas to the coolant as a thermal bridge, the coolant jacket is filled with coolant from the container via the supply line.

Embodiments of the forced-induction internal combustion engine are advantageous in which a first shutoff element is arranged in the discharge line. The opened first shutoff element allows the at least one coolant jacket to be emptied, i.e. allows coolant to be discharged. A closed first shutoff element prevents coolant from draining into the container and prevents coolant from circulating in the second coolant circuit via the container.

Embodiments of the forced-induction internal combustion engine are advantageous in which a second shutoff element is arranged in the supply line. The opened second shutoff element allows the at least one coolant jacket to be filled with coolant from the container, i.e. allows coolant to be supplied.

Embodiments of the forced-induction internal combustion engine are advantageous in which a pump for delivering the coolant is provided in the second coolant circuit. The pump can be activated and used to empty the at least one coolant jacket or to fill the at least one coolant jacket. The pump can also serve to make the coolant circulate in the second coolant circuit. For reasons connected with energy, the latter option should be chosen only if there is an acute need.

In this context, embodiments of the forced-induction internal combustion engine are advantageous in which the pump is arranged in the discharge line.

If a container is provided for storing the coolant for the second coolant circuit, embodiments are advantageous in which a bypass line for bypassing the container is provided, said bypass line branching off from the discharge line and opening into the supply line.

In this context, embodiments of the forced-induction internal combustion engine are advantageous in which a heat exchanger, which serves to dissipate heat from the coolant, is arranged in the bypass line.

In this case embodiments of the forced-induction internal combustion engine are advantageous in which the heat exchanger is a radiator, which removes heat from the coolant in the second coolant circuit by virtue of convection owing to a supply of air. It is advantageous if the radiator is fitted with a powerful fan to assist air cooling or heat transfer by virtue of convection.

However, embodiments of the forced-induction internal combustion engine can also be advantageous in which the heat exchanger is a coolant-operated heat exchanger which removes heat from the coolant in the second coolant circuit by using a liquid, wherein the heat is introduced into the liquid from the coolant.

The coolant in the first coolant circuit can also serve or be used as the liquid for the coolant-operated heat exchanger. In that case, the coolant circuits, i.e. the first coolant circuit and the second coolant circuit, once again connected, i.e. coupled, to one another thermally.

Embodiments of the forced-induction internal combustion engine are advantageous in which a third shutoff element is arranged in the bypass line upstream of the heat exchanger.

Embodiments of the forced-induction internal combustion engine are advantageous in which a fourth shutoff element is arranged in the bypass line downstream of the heat exchanger.

Opening the third and fourth shutoff elements serves to release the bypass line if the coolant in the second coolant circuit is supposed to circulate and flow through the at least one coolant jacket. In this case, the first and second shutoff elements are closed. The bypass line preferably branches off from the discharge line upstream of the first shutoff element and preferably opens into the supply line downstream of the second shutoff element.

Embodiments of the forced-induction internal combustion engine are advantageous in which at least one exhaust gas aftertreatment system is provided in the exhaust system upstream of the junction, especially if the recirculated exhaust gas is passed through a compressor on the intake side.

In this case, embodiments of the forced-induction internal combustion engine are advantageous in which a particle filter is provided as an exhaust gas aftertreatment system for aftertreating the exhaust gas.

To minimize soot emissions, use is made in the present case of a regenerative particle filter, which filters the soot particles out of the exhaust gas and stores them, wherein these soot particles are burnt intermittently in the course of regenerating the filter. In the absence of catalytic assistance, the temperatures needed to regenerate the particle filter are around 550° C. Normally, therefore, recourse is had to additional measures to ensure regeneration of the filter under all operating conditions.

Regeneration of the filter introduces heat into the exhaust gas and increases the exhaust gas temperature and hence the exhaust gas enthalpy. At the outlet of the filter, therefore, there is an energy-rich exhaust gas available that can be used in the manner according to the present disclosure.

Embodiments of the forced-induction internal combustion engine can also be advantageous in which an oxidation catalyst is provided as an exhaust gas aftertreatment system for aftertreating the exhaust gas.

Admittedly, oxidation of the unburnt hydrocarbons and of carbon monoxide takes place in the exhaust system even without additional measures if there is a sufficiently high temperature level and there are sufficiently large quantities of oxygen present. However, these reactions quickly subside owing to the rapid downstream decrease in exhaust gas temperature and the consequent rapid fall in the reaction rate. Use is therefore made of catalytic reactors, which ensure oxidation, even at low temperatures, by using catalytic materials. If there is an additional requirement to reduce nitrogen oxides, this can be achieved, in the case of a spark-ignition engine, by the use of a three-way catalyst.

Oxidation is an exothermic reaction, wherein the heat released increases the temperature and therefore the enthalpy of the exhaust gas. At the outlet of the oxidation catalyst, therefore, there is an energy-rich exhaust gas available. Thus, the provision of an oxidation catalyst is appropriate and advantageous, especially also in respect of the use according to the present disclosure of the exhaust gas energy.

Embodiments of the forced-induction internal combustion engine can also be advantageous in which a storage catalyst is provided as an exhaust gas aftertreatment system for aftertreating the exhaust gas.

To reduce the nitrogen oxides, selective catalysts can be used, in which reducing agent is introduced selectively into the exhaust gas in order to selectively reduce the nitrogen oxides. Apart from ammonia and urea, unburnt hydrocarbons are also used as reducing agents.

Nitrogen oxide emissions can also be reduced by means of storage catalysts. In this case, the nitrogen oxides are initially absorbed, i.e. collected and stored, in the catalyst during lean-mixture operation of the internal combustion engine, and are then released and reduced during a regeneration phase, e.g. by means of a substoichiometric operation of the internal combustion engine with a deficiency of oxygen.

The sulfur contained in the exhaust gas is likewise absorbed in the storage catalyst and must be removed at regular intervals in the course of "desulfurization". For this purpose, temperatures between 600° C. and 700° C. are needed.

Embodiments of the forced-induction internal combustion engine are advantageous in which the exhaust gas recirculation system is fitted with a shutoff element, which acts as an EGR valve and is used to set the recirculation rate, i.e. the exhaust gas volume recirculated.

The use of a combination valve allows metering of the recirculated exhaust gas volume and, at the same time, restriction of the fresh air volume drawn in.

In this context, embodiments of the forced-induction internal combustion engine are advantageous in which the shutoff element is arranged in the recirculation line downstream of the cooler.

Embodiments of the forced-induction internal combustion engine are advantageous in which a bypass line is provided for bypassing the cooler, which bypass line bridges the EGR cooler and by means of which bypass line the exhaust gas recirculated via the exhaust gas recirculation system can be introduced into the intake system while bypassing the cooler.

It can be expedient to bridge the EGR cooler, e.g. in order to avoid additional heat being introduced into the liquid cooling system of the internal combustion engine. Such a procedure is appropriate if the liquid cooling system of the internal combustion engine is already highly stressed, e.g. at high load. If the exhaust gas recirculation system is used as part of an engine brake, it is likewise expedient to recirculate the hot exhaust gas without cooling.

Embodiments of the forced-induction internal combustion engine are advantageous in which a liquid cooling system is provided to form an engine cooling system.

In this context, embodiments of the forced-induction internal combustion engine are advantageous in which the at least one cylinder head of the internal combustion engine is fitted with at least one coolant jacket integrated into the cylinder head in order to form a liquid cooling system.

A liquid cooling system proves advantageous, particularly with forced-induction engines, since the thermal loading of forced-induction engines is significantly higher than that of conventional internal combustion engines. If the cylinder head has an integrated exhaust manifold, this is subject to higher thermal stress than a conventional cylinder head fitted with an external manifold. Increased demands are made on the cooling system.

In this context, embodiments of the forced-induction internal combustion engine are advantageous in which the liquid cooling system comprises the first coolant circuit, in which the cooler is arranged.

If the EGR cooler is incorporated into the cooling circuit of the engine cooling system, it is in principle only desired to provide single instances of a large number of components and units that are needed to form a circuit since these can be used both for the cooling circuit of the EGR cooler and for that of the engine cooling system, and this leads to synergies and cost savings but also involves a weight saving.

Thus, just one pump is preferably provided to deliver the coolant and just one container is provided to store the coolant. The heat released to the coolant by the internal combustion engine and in the EGR cooler can be removed from the coolant in a common heat exchanger.

It is likewise easier in this way to use the exhaust gas energy or exhaust gas heat absorbed by the coolant in the EGR cooler, e.g. to heat the internal combustion engine or the engine oil.

The second partial object underlying the present disclosure, namely that of indicating a method for operating a forced-induction internal combustion engine of a type described above, is achieved by a method wherein the at least one coolant jacket is filled with coolant, and the cooler is activated when the exhaust gas recirculation system is deactivated, such that coolant is passed through the core, with the result that heat is transferred from the exhaust gas into the coolant in the core via the coolant situated in the at least one coolant jacket.

What has already been stated in respect of the forced-induction internal combustion engine according to the present disclosure also applies to the method according to the present disclosure. Different embodiments of the internal combustion engine according to the present disclosure demand correspondingly different method variants, in respect of which attention is drawn to the corresponding explanations.

Method variants are desired in which the cooler is activated in the warm-up phase or after a cold start of the internal combustion engine.

After a cold start of the internal combustion engine, there is a desire to selectively heat the engine oil or the internal combustion engine. By virtue of the arrangement according to the present disclosure of the EGR cooler in the exhaust system of the internal combustion engine, the hot exhaust gas can be used even when the exhaust gas recirculation system is deactivated.

That is to say that, despite the exhaust gas recirculation system being deactivated in the warm-up phase, heat can be transferred from the exhaust gas to the coolant in the core. The coolant flowing through the core dissipates the heat from the interior of the cooler and makes it available for a specifiable use.

Method variants are advantageous in which the at least one coolant jacket is at least partially emptied, preferably very largely emptied, by discharging the coolant if there is no demand.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
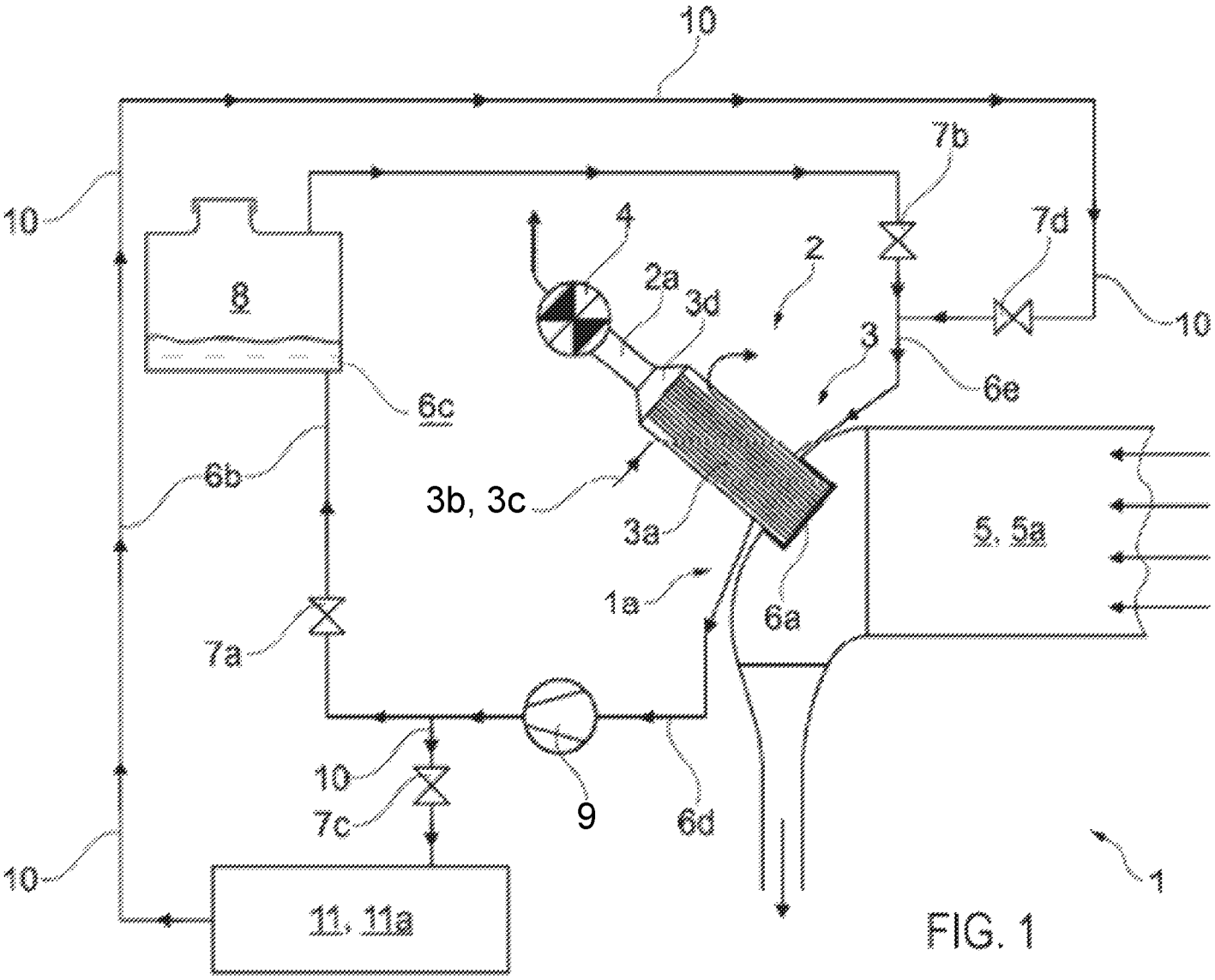
FIG. 1 shows schematically a fragment of the exhaust system of a first embodiment of the forced-induction internal combustion engine together with the exhaust gas recirculation system and coolant circuits.

The following description relates to systems and methods for an EGR cooler having a first coolant jacket fluidly separated from a second coolant jacket. The second coolant jacket is smaller than the first coolant jacket, and is located at an interface between the EGR cooler and the particulate filter outlet. This is shown in FIG. 1. The first coolant jacket is configured to cool exhaust gas and is fluidly coupled to a first coolant system configured to adjust engine combustion and engine oil temperatures, as is known in the art. The second coolant jacket may be used under a plurality of conditions, including but not limited to mitigating condensate formation, increasing engine oil and/or engine combustion temperatures, and decreasing a first coolant jacket temperature, as shown in FIGS. 4-7. An engine having at least one combustion chamber with an exhaust passage coupled thereto having the EGR cooler described above is shown in FIG. 2. First and second coolant circuits fluidly coupled to the first and second coolant jackets, respectively, are shown in FIG. 3. FIG. 8 graphically displays engine operating parameters overtime as one or more of the methods described herein as used in conjunction with the coolant jackets of the EGR cooler.

The internal combustion engine has an exhaust system 1 for discharging the exhaust gases from the cylinders.

The forced-induction internal combustion engine is fitted with an exhaust gas recirculation system 2. To form the exhaust gas recirculation system 2, a recirculation line 2*a* is provided, which, while forming a junction 1*a*, branches off from the exhaust system 1 and opens into the intake system and in which a cooler 3 is arranged, which, when the exhaust gas recirculation system 2 is activated, lowers the temperature in the hot exhaust gas to be recirculated before the recirculated exhaust gas is mixed with fresh air in the intake system.

Arranged in the recirculation line 2*a* there is furthermore a shutoff element 4, which acts as an EGR valve 4 and is used to set the recirculated exhaust gas volume. The exhaust gas recirculation system 2 optionally has a bypass line for bridging the cooler 3 (not shown).

The cooler 3 has an outlet cone 3*d* and a core 3*a*, which conducts coolant 3*c*, wherein the core 3*a* is incorporated into a first coolant circuit 3*b* and the coolant 3*c* circulating or passed through the core 3*a* removes heat from the hot exhaust gas. The heat transferred to the coolant 3*c* from the exhaust gas is fed to a predeterminable use, i.e., the exhaust gas energy is made usable or is used. The efficiency of the internal combustion engine is thereby increased.

The cooler 3 projects into the exhaust system 1 in the region of the core 3*a*, with the result that there is a flow of hot exhaust gas around at least some area or areas of the core 3*a* conducting coolant 3*c*, or that this/these are subjected to hot exhaust gas, even when the exhaust gas recirculation system 2 is deactivated and no exhaust gas at all is being recirculated. By virtue of this arrangement of the EGR cooler 3 in the exhaust system 1, the hot exhaust gas can be used even when the exhaust gas recirculation system 2 is deactivated.

The arrangement of the cooler 3 furthermore makes it possible to eliminate an inlet cone in order to increase the cross section of the recirculation line 2*a* to the larger cross section of the core 3*a*. Eliminating the inlet cone allows a compact design of the exhaust gas recirculation system 2 overall and dense packaging in the engine compartment.

A coolant jacket 6*a* of a second coolant circuit 6*b* is furthermore provided in the cooler 3, said coolant jacket conducting coolant 6*c* and being arranged between the core 3*a* conducting coolant 3*c* and the exhaust system 1 conducting exhaust gas. To form the second coolant circuit 6*b*, a discharge line 6*d* for discharging the coolant 6*c* and a supply line 6e for supplying the coolant 6c are provided, as is a container 8 for storing the coolant 6c, wherein the container 8 can be connected to the coolant jacket 6a via discharge line 6d and supply line 6e.

The coolant jacket 6a is intended to thermally couple or separate the core 3a conducting coolant 3c and the exhaust system 1 conducting exhaust gas. For this purpose, the coolant jacket 6a of the second coolant circuit 6b can either be filled with coolant 6c or freed from coolant 6c and emptied.

A coolant jacket 6a filled with coolant 6c serves as a thermal bridge for the introduction of heat from the exhaust gas into the coolant 3c in the core 3a. In this case, the coolant 6c in the coolant jacket 6a preferably does not circulate in the second coolant circuit 6b.

A coolant jacket 6a freed from coolant 6c, i.e. at least partially emptied, serves as a thermal barrier, which is intended to make the introduction of heat from the exhaust gas into the coolant 3c in the core 3a more difficult or to prevent it.

A first shutoff element 7a is arranged in the discharge line 6d, and a second shutoff element 7b is arranged in the supply line 6e. Opening the first shutoff element 7a allows coolant 6c to be discharged into the container 8, i.e. allows emptying of the coolant jacket 6a. Closing the first shutoff element 7a prevents coolant from draining into the container 8 and circulation of coolant 6c in the second coolant circuit 6b via the container 8. The opened second shutoff element 7b allows the coolant jacket 6a to be filled with coolant 6c from the container 8.

To deliver the coolant 6c in the second coolant circuit 6b, a pump 9 is provided in the discharge line 6d, which pump can be used to empty or fill the coolant jacket 6a and to circulate the coolant 6c in the second coolant circuit 6b.

In the present case, a bypass line 10 for bypassing the container 8 is provided, said bypass line branching off from the discharge line 6d between the pump 9 and the first shutoff element 7a and opening into the supply line 6e downstream of the second shutoff element 7b.

Arranged in the bypass line 10 is a radiator 11a, which acts as a heat exchanger 11 and removes heat from the coolant 6c in the second coolant circuit 6b by virtue of convection owing to a supply of air.

If the coolant 6c in the filled coolant jacket 6a overheats and there is a risk of evaporation of coolant 6c, the coolant 6c in the second coolant circuit 6b can circulate via bypass line 10 in order to dissipate in the radiator 11a the heat introduced into the coolant 6c from the exhaust gas. Arranged in the bypass line 10 there is a third shutoff element 7c upstream of the heat exchanger 11 and a fourth shutoff element 7d downstream of the heat exchanger 11. Opening the third and fourth shutoff elements 7c, 7d serve to release the bypass line 10 if the coolant 6c in the second coolant circuit 6b is supposed to circulate and flow through the coolant jacket 6a. The first and second shutoff elements 7a, 7b are closed during this process.

A particle filter 5a is provided as an exhaust gas aftertreatment system 5 upstream of the junction 1a in order to aftertreat the exhaust gas.

In this way, FIG. 1 shows an EGR cooler having first and second coolant jackets fluidly coupled to separate coolant circuits. The second coolant jacket is in thermal communication with exhaust gas in an exhaust passage directly downstream of a particulate filter. The first jacket is not in thermal communication with exhaust gas in the exhaust passage, but is in thermal communication with exhaust gas flowing through the EGR cooler. As such, coolant in the second coolant jacket is heated by exhaust gas in the exhaust gas passage and coolant in the first coolant jacket is heated by exhaust gas in the EGR cooler. Additionally, the coolants in the separate coolant jackets may thermally communicate with one another. As such, exhaust heat energy may be utilized even when EGR is off.

Figure 2:
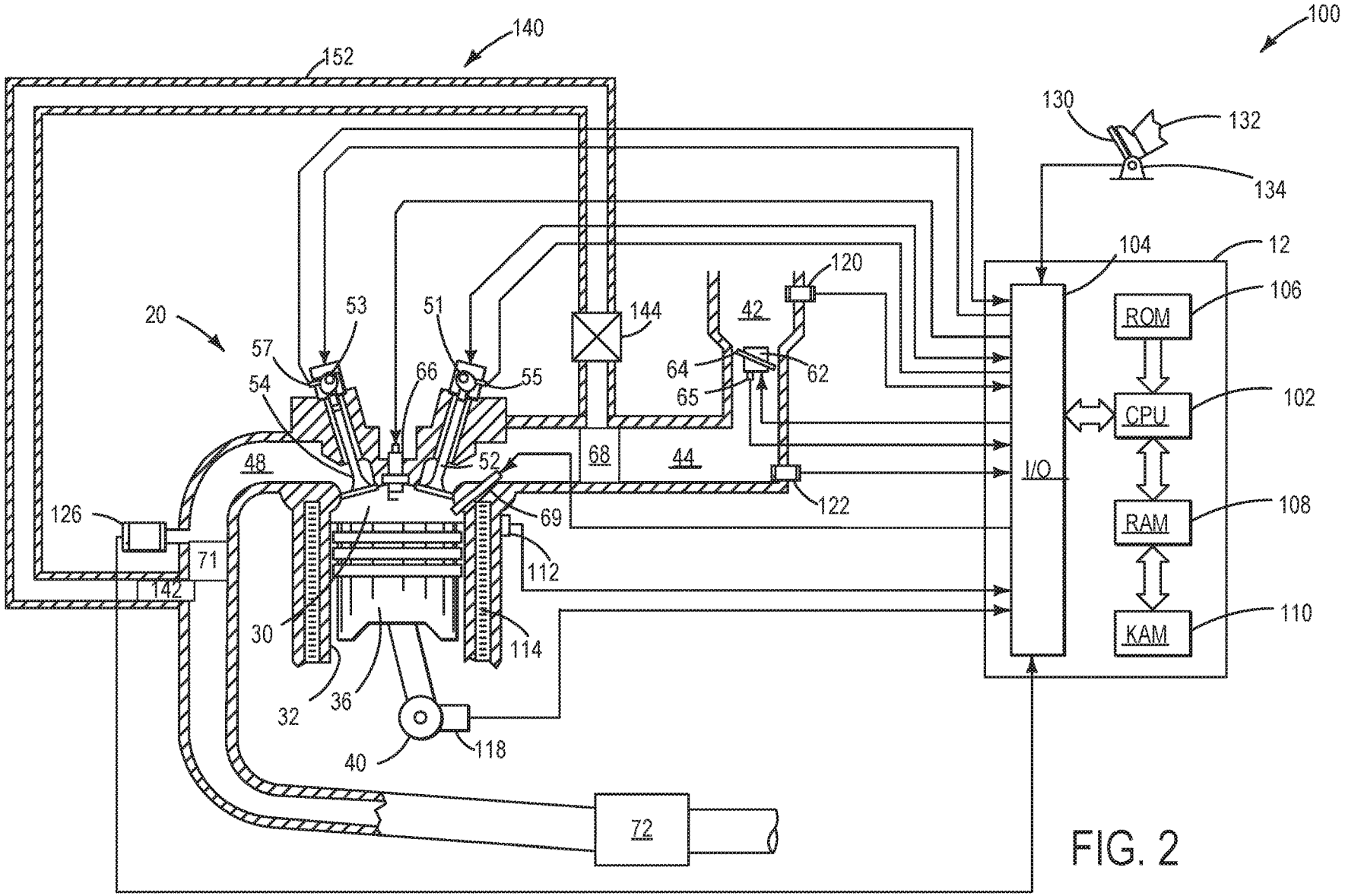
FIG. 2 shows a schematic for an engine having at least one cylinder.
Figure 3:
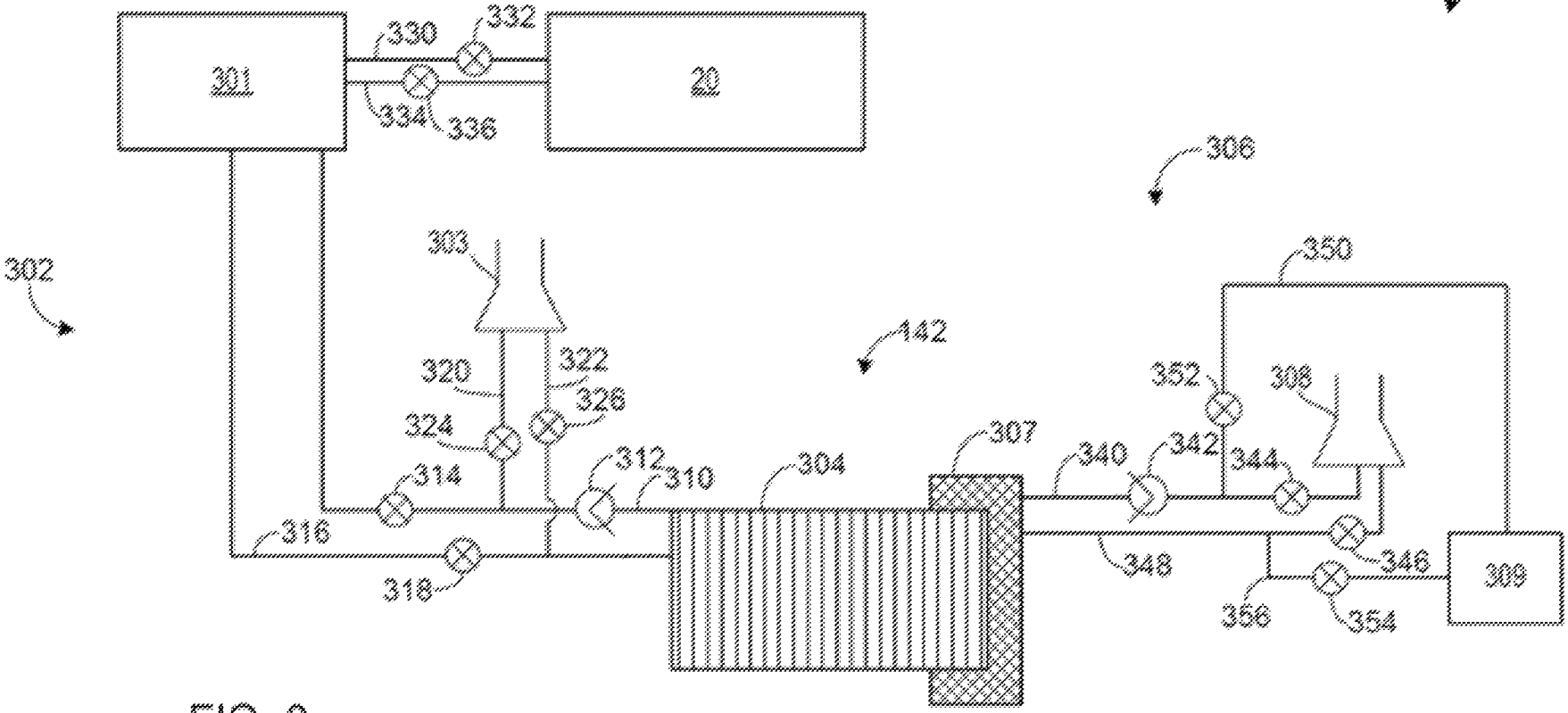
FIG. 3 shows an illustration of a first coolant circuit fluidly coupled to the first coolant jacket and a second coolant circuit fluidly coupled to the second coolant jacket.

Turning now to FIG. 2, a schematic diagram showing one cylinder of a multi-cylinder engine 20 in an engine system 100, which may be included in a propulsion system of an automobile, is shown. The engine 20 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 20 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 20.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 20.

An exhaust gas sensor 126 is shown coupled to the exhaust passage 48 upstream of an emission control device 72 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 72 is shown arranged along the exhaust passage 48 downstream of both the exhaust gas sensor 126. The device 72 may be a three way catalyst (TWC), $NO_x$ trap, selective catalytic reductant (SCR), various other emission control devices, or combinations thereof. In some examples, during operation of the engine 20, the emission control device 72 may be periodically reset by operating at least one cylinder of the engine within a particular air-fuel ratio.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes. The EGR system further includes an EGR cooler 142 located at a junction between the exhaust gas passage 48 and the EGR passage 152. A portion of the EGR cooler extends into the exhaust passage 48 at an area directly downstream of an emission control device 71. In one example, the emission control device 71 is substantially identical to the emission control device 72. Additionally or alternatively, the emission control device 71 is a particulate filter and the emission control device is a different aftertreatment device (e.g., a three-way catalyst). In one example, the EGR cooler 142 is substantially similar to the EGR cooler 3 of FIG. 1. In this way, the EGR cooler 142 comprises two coolant jackets, with one of the coolant jackets being thermally coupled to exhaust gas in the exhaust gas passage.

The controller 12 is shown in FIG. 2 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 20, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

The controller 12 receives signals from the various sensors of FIG. 2 and employs the various actuators of FIG. 2 to adjust engine operation based on the received signals and instructions stored on a memory of the controller. For example, adjusting a reactivity of the SCR may include adjusting an actuator of the urea injector to inject urea to cover surfaces of the SCR with urea. For example, adjusting an injection into the mixer may include adjusting an actuator of the injector to open an orifice of the injector to spray an amount of fluid into the mixer.

Turning now to FIG. 3, it shows an embodiment 300 of a first coolant circuit 302 fluidly coupled to a first coolant jacket 304 and a second coolant circuit 306 fluidly coupled to a second coolant jacket 308. The first coolant jacket 304 may be substantially identical to the core of the cooler 3*a* of FIG. 1. As such, the first coolant circuit 302, along with one or more components located therein, may be used similarly to the first coolant circuit 3*b* of FIG. 1. Likewise, the second coolant jacket 307 may be substantially identical to the coolant jacket 6*a* of FIG. 1. As such, the second coolant circuit 306, along with one or more components located therein (e.g., pump 342 may be substantially similar to pump 9), may be used similarly to the second coolant circuit 6*b*.

The first coolant circuit 302 comprises a degas bottle 303, a radiator 301, and the engine 20 of FIG. 1. In this way, the first coolant circuit 302 may be a primary coolant circuit, wherein coolant from the first coolant circuit 302 flows through and thermally communicates with one or more engine components. For example, the first coolant circuit 302 is configured to adjust one or more of an engine combustion temperature, engine oil temperature, transmission oil temperature, etc. Additionally, the first coolant circuit 302 is configured to adjust a temperature of exhaust gas flowing through the EGR cooler 142. Specifically, the first coolant circuit 302 delivers coolant to the first coolant jacket 304, which is in face-sharing contact with exhaust gas flowing through the EGR cooler 142. However, the first coolant jacket 304 is not in face-sharing contact and does not thermally communicate with exhaust gas outside of the EGR cooler 142 (e.g., exhaust gas in the exhaust passage).

A first coolant outflow line 310 comprises a pump 312 configured to assist in coolant flow to and from the first coolant jacket 304. The first outflow line 310 is fluidly coupled to the radiator 301 and a degas inlet line 320. If a first outflow line valve 314 is in a more open position, then at least some coolant from the first coolant outflow line 310 flows to the radiator 301. Likewise, if a degas inlet line valve 324 is in a more open position, then at least some coolant from the first coolant outflow line 310 flows to the degas bottle 303. In one example, a more open position of a valve allows a greater amount of coolant or other substance to flow therethrough compared to a less open position (e.g., a more closed position). As such, coolant flow from the first coolant jacket 304 to the radiator 301 and the degas bottle 303 may be at least partially adjusted by the pump 312, the first outflow line valve 314, and the degas inlet line valve 324. The coolant circuit may also comprise a bypass line 362 to bypass the cooler.

If the first outflow line valve 314 is in a fully closed position and the degas inlet line valve 324 is in a fully open position, then all the coolant from the first coolant jacket 304 is directed to the degas bottle 303, where air and/or other gases are removed from the first coolant circuit 302. Coolant from the degas bottle 303 may be directed back to the first coolant jacket 304 when a degas outflow line valve 326 of a degas outflow line 322 is in an at least partially open position. The coolant flows through the degas outflow line 322, through the partially open degas outflow line valve 326, and into the first coolant inlet line 316. The first coolant inlet line 316 directs the depressurized coolant from the degas bottle 303 to the first coolant jacket 304.

If the first outline line valve 314 is in the fully open position and the degas inlet line valve 324 is in the fully closed position, then coolant from the first coolant jacket flows to the radiator 301 and does not flow to the degas bottle 303. Coolant in the first radiator 301 may be cooled via ram air and/or air flow from a mechanical device (e.g., a fan). The first radiator 301 is further configured to direct coolant to the engine 20 via an engine inlet line 330 and engine inlet line valve 332. If the engine inlet line valve 332 is in an at least partially open position, then coolant from the radiator 301 may flow to the engine 20. In one example, coolant flowing to the engine 20 flows into a combustion chamber cooling sleeve 114. In this way, the coolant from the first coolant circuit may thermally communicate with one or more engine components (e.g., combustion chamber coolant jacket, engine oil, etc.). Coolant may flow to the radiator 301 from the engine 20 via an engine outflow line 334 and engine outflow line valve 336. In one example, if the engine outflow line valve 336 is in an at least partially open position then coolant from the engine 20 flows to the radiator 301.

Coolant may flow from the radiator 301 and to the first coolant jacket 304 via the first coolant inlet line 316 when a first coolant inlet line valve 318 is in an at least partially open position. Coolant flowing through the at least partially open first coolant inlet line valve 318 flows to only the first coolant jacket 304 and does not flow into the degas bottle 303. In one example, additionally or alternatively, the radiator 301 may comprise a separate coolant line directly coupling it to the degas bottle 303.

The second coolant circuit 306 is fluidly coupled to the second coolant jacket 307, a degas bottle 308, and a radiator 309. As shown, the degas bottle 308 and the radiator 309 are fluidly separated from the radiator 301 and the degas bottle 303. The second coolant jacket 307 is configured to thermally communicate with exhaust gas flowing through the EGR cooler 142 and/or through an exhaust passage. In this way, the second coolant jacket 307 may thermally communicate with exhaust gas even when the exhaust gas is not flowing through the EGR cooler 142. Additionally, the second coolant jacket 307 is configured to become thermally insulated from exhaust gas flowing through the exhaust passage. This may be accomplished by vacating the second coolant jacket 307 of coolant and filling it with air. Coolant may flow out of the second coolant jacket 307 via a second coolant outflow line 340. A pump 342 is arranged in the second jacket outflow line 340, where the pump 342 may assist coolant flow through the second coolant circuit 306. The second coolant outflow line 340 is fluidly coupled to a radiator inlet line 350 and the degas bottle 308. If a radiator inlet line valve 352 is in a fully closed position and a degas bottle inlet valve 344 is in a fully open position, then coolant from the second coolant jacket 307 flows to the degas bottle 308 without flowing to the radiator 309. Coolant in the degas bottle may be depressurized and flow back to the second coolant jacket 307 when a degas bottle outlet valve 346, arranged along a second coolant inlet line 348, is in an at least partially open position.

If the radiator inlet line valve 352 is in the fully open position and the degas bottle inlet line valve 344 is in the fully closed position, then coolant from the second coolant jacket 307 flows to only the radiator 309 via the radiator inlet line 350 without flowing to the degas bottle 308. The radiator 309 may adjust a temperature of coolant in the second coolant circuit 306 via ram air and/or one or more devices (e.g., a fan). Coolant may flow from the radiator to the second coolant jacket 307 when a radiator outlet line valve 354, which is arranged in a radiator outlet line 356, is in an at least partially open position. Coolant flows from the radiator 309, through the at least partially open radiator outlet line valve 354, through the radiator outlet line 356, into the second coolant inlet line 348, and into the second coolant jacket 307. In some example, the radiator 309 may comprise separate passages directly coupling the radiator 309 to the degas bottle 308.

As shown, the first coolant circuit 302 is hermetically sealed from the second coolant circuit 306. In this way, coolant in the first coolant circuit 302 does not mix and/or merge and/or combine with coolant in the second coolant circuit 306. In one example, coolant in the first coolant circuit 302 only thermally communicates with coolant in the second coolant circuit at an interface between the first coolant jacket 304 and the second coolant jacket 307. As shown, the second coolant jacket 307 surrounds at least a portion of the first coolant jacket 304. As described above, the second coolant jacket 307 extends into a portion of an exhaust passage directly downstream of a particulate filter. In one example, the second coolant jacket 307 is the only portion of the EGR cooler 142 in thermal communication with exhaust gas in the exhaust passage. As such, the remaining portion of the EGR cooler 142 may thermally communicate directly with exhaust gas when exhaust gas is flowing directly through the EGR cooler 142. However, by protruding the second coolant jacket 307 into the exhaust gas passage, thermally energy of exhaust gas may be supplied from the second coolant jacket 307 to the first coolant jacket 304, without flowing exhaust gas through the EGR cooler 142. This will be described in greater detail below. Methods for adjusting coolant flow to the second coolant jacket for heating coolant in the first coolant jacket, cooling coolant in the first coolant jacket via coolant in the second coolant jacket 307, and thermally insulating coolant in the first coolant jacket 304 from exhaust gas in the exhaust gas passage are described below.

While components of the first 302 and second 306 coolant circuits are shown separate and different than one another, it will be appreciated that in some embodiments, the coolant circuits may share one or more of a radiator and a degas bottle.

Thus, a system comprises an EGR cooler arranged in an EGR passage, where the cooler comprises a first coolant jacket hermetically sealed from a second coolant jacket, and where a portion of the cooler comprising the second coolant jacket protrudes into a portion of an exhaust passage directly downstream of an aftertreatment device. The first coolant jacket is fluidly coupled to a first coolant circuit, the first coolant circuit being fluidly coupled to an engine, and where the second coolant jacket is fluidly coupled to a second coolant circuit. The second coolant jacket is located between the exhaust passage and the first coolant jacket. The second coolant jacket is in direct thermal communication with exhaust gas in the exhaust passage and where the first coolant jacket is in direct thermal communication with exhaust gas in the EGR cooler. A controller with computer-readable instructions that when executed enable the controller to flow coolant from the second coolant circuit to the second coolant jacket when EGR is not desired, and flow air from the second coolant circuit to the second coolant jacket when exhaust heat energy is not desired.

Figure 4:
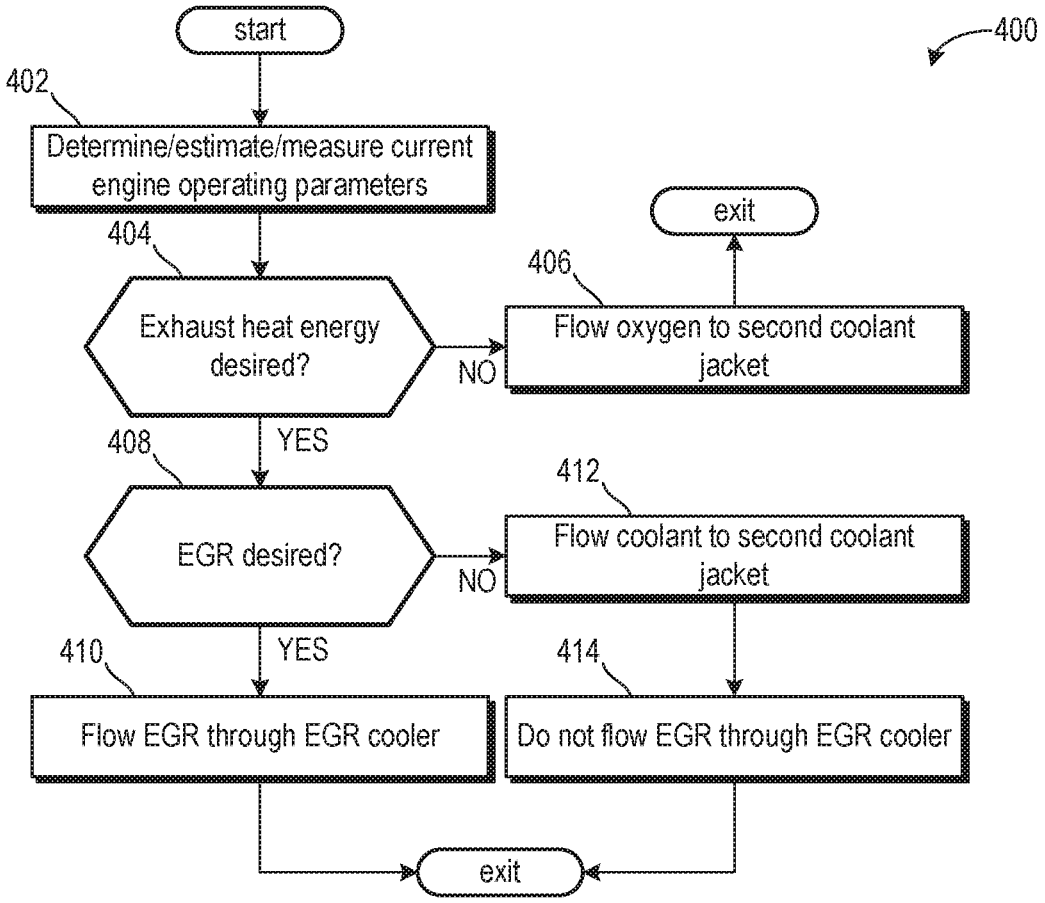
FIG. 4 shows a high-level flow chart for flowing coolant.

Turning now to FIG. 4, it shows a high-level flow chart illustrating a method 400 for flowing coolant to the second coolant jacket. Instructions for carrying out method 400 and the rest of the methods included herein may be executed by a controller (e.g., controller 12) based on instructions stored on a memory of the controller and in conjunction with signals received from sensors of the engine system, such as the sensors described above with reference to FIG. 2. The controller may employ engine actuators of the engine system to adjust engine operation, according to the methods described below.

The method 400 may begin at 402, where the method determines, estimates, and/or measures current engine operating parameters. Current engine operating parameters may include, but is not limited to, one or more of an engine speed, engine temperature, vehicle speed, manifold pressure, and air/fuel ratio.

At 404, the method determines if exhaust heat energy is desired. Exhaust heat energy may be desired if an engine temperature is less than a threshold engine temperature and if an engine oil temperature is less than a threshold oil temperature. Additionally or alternatively, exhaust heat energy may be desired if a likelihood of condensate forming in the EGR cooler is greater than a threshold likelihood. At any rate, if exhaust heat energy is not desired, then the method proceeds to 406 to flow oxygen to the second coolant jacket. In this way, the second coolant jacket is vacated of coolant. The oxygen fills the second coolant jacket, which thermally insulates coolant in the first coolant jacket from exhaust gas flowing through an exhaust passage. In this way, air in the second coolant jacket is marginally heated (e.g., less than 1° C.) by exhaust gas in the exhaust gas passage such that a temperature of coolant in the first coolant jacket is unchanged.

If the exhaust heat energy is desired, then the method proceeds to 408 to determine if EGR is desired. If EGR is desired, then the method proceeds to 410 to flow EGR through the EGR cooler. In some example, flowing EGR through the EGR cooler includes flowing coolant to the first coolant jacket and not flowing coolant to the second coolant jacket. As such, the second coolant jacket may be filled with air during certain instances of EGR flow. Additionally or alternatively, coolant from the first coolant circuit may flow to the first coolant jacket and coolant from the second coolant circuit may flow to the second coolant jacket when EGR is desired. As such, both coolant jackets may thermally communicate with each other and exhaust gas.

If EGR is not desired, then the method proceeds to 412 to flow coolant from the second coolant circuit to the second coolant jacket. In this way, exhaust gas in the exhaust passage may heat coolant in the second coolant jacket. Coolant in the second coolant jacket may thermally communicate with coolant in the first coolant jacket, thereby realizing the benefits of exhaust heat energy without flowing EGR. This may be desired following a cold-start where engine oil and/or other engine components are below desired temperatures.

At 414, the method includes not flowing EGR through the EGR cooler.

Thus, a method, comprising flowing coolant from a first coolant circuit to a first coolant jacket of an exhaust gas recirculation cooler, flowing coolant from a second coolant circuit to a second coolant jacket of the exhaust gas recirculation cooler, and heating coolant in the first coolant jacket with coolant in the second coolant jacket when exhaust gas recirculation is deactivated. The first coolant circuit is fluidly coupled to an engine. The flowing coolant from the second coolant circuit to the second coolant jacket occurs following a cold-start. The flowing coolant from the second coolant circuit to the second coolant jacket occurs when a coolant temperature in the first coolant jacket is greater than or equal to an upper threshold temperature. The flowing coolant from the second coolant circuit to the second coolant jacket occurs when an amount of condensate in an EGR cooler is greater than or equal to a threshold condensate amount.

Figure 5:
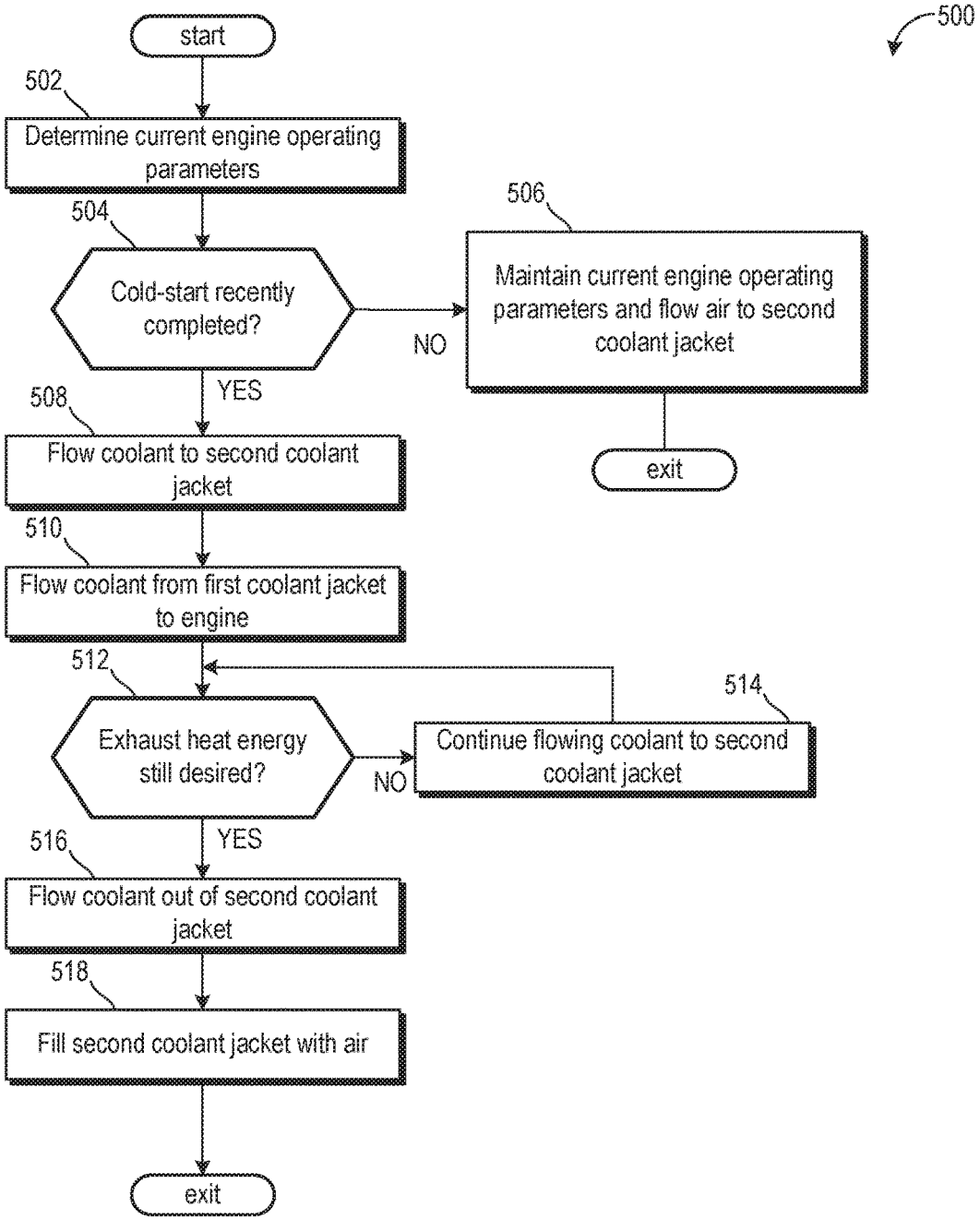
FIG. 5 shows a detailed flow chart for utilizing exhaust heat energy when EGR is not desired.

Turning now to FIG. 5, a method 500 for utilizing exhaust heat energy following a cold-start when EGR is undesired is shown. The method includes flowing coolant from the second circuit to the second coolant jacket following completion of a cold-start. Since EGR is undesired, the coolant in the second coolant jacket is heated by the hot exhaust gas. The hot coolant in the second coolant jacket heats the coolant in the first coolant jacket, which may flow through the first coolant circuit, as shown in FIG. 3.

The method 500 begins at 502, where the method determines, estimates, and/or measures current engine operating parameters. Current engine operating parameters may include, but is not limited to, one or more of an engine speed, engine temperature, vehicle speed, manifold pressure, and air/fuel ratio.

At 504, the method includes determining if a cold-start was recently completed. The cold-start is recent if it is within a threshold amount of time (e.g., 30 seconds). A cold-start is completed if an engine temperature is greater than an ambient temperature, in one example. If a cold-start was not recently completed or if a cold-start is still ongoing, then the method proceeds to 506 to maintain current engine operating parameters. Additionally or alternatively, the method includes flowing air to the second coolant jacket and vacating the second coolant jacket of coolant. In other embodiments, additionally or alternatively, coolant from the second coolant circuit flows to the second coolant jacket.

If the cold-start was recently completed, then the method proceeds to 508 to flow coolant from the second coolant circuit to the second coolant jacket. It will be appreciated that coolant from the first coolant circuit may already occupy the first coolant jacket. In this way, the coolant in the second coolant jacket is heated by hot exhaust gas flowing through the exhaust passage. The hot exhaust gas does not flow through the EGR cooler since EGR is undesired following the cold-start. In this way, a temperature of the coolant in the second coolant jacket rises, which may increase a temperature of coolant in the first coolant jacket.

At 510, the method includes flowing the coolant from the first jacket to the engine, where the coolant may reduce engine friction by heating engine oil and/or increase an engine operating temperature. In this way, exhaust heat energy is utilized outside of an EGR demand. By doing this, exhaust heat energy may more rapidly heat engine components compared to a vehicle lacking a second coolant jacket, such as the second coolant jacket described above.

At 512, the method includes determining if exhaust heat energy is still desired. This may include determining if the engine components are sufficiently hot. This may include comparing an engine oil temperature to a threshold oil temperature, where the threshold oil temperature is based on sufficient lubrication and reduction in friction of engine components. If the engine components are not sufficiently hot and exhaust heat energy is still desired, then the method proceeds to 514 to continue flowing coolant to the second coolant jacket. This allows the coolant in the second coolant jacket to continue heating coolant in the first coolant jacket without flowing exhaust gas through EGR cooler.

If the engine components are sufficiently heated and exhaust heat energy is no longer desired, then the method proceeds to 516 to flow coolant out of the second coolant jacket. This may include activating a pump (e.g., pump 342 of FIG. 3) opening one or more valves (e.g., at least partially opening one or more of the degas inlet line valve 344 and the radiator inlet line valve 352. At 518, the method includes filling the second coolant jacket with air. This may include maintaining the degas outlet valve 346 and the radiator outlet line valve 354 closed such that air may fill the second coolant jacket via connection 360 as coolant flows out. As described above, filling the second coolant jacket with air may thermally insulate coolant in the first coolant jacket from exhaust gas in the exhaust passage.

Figure 6:
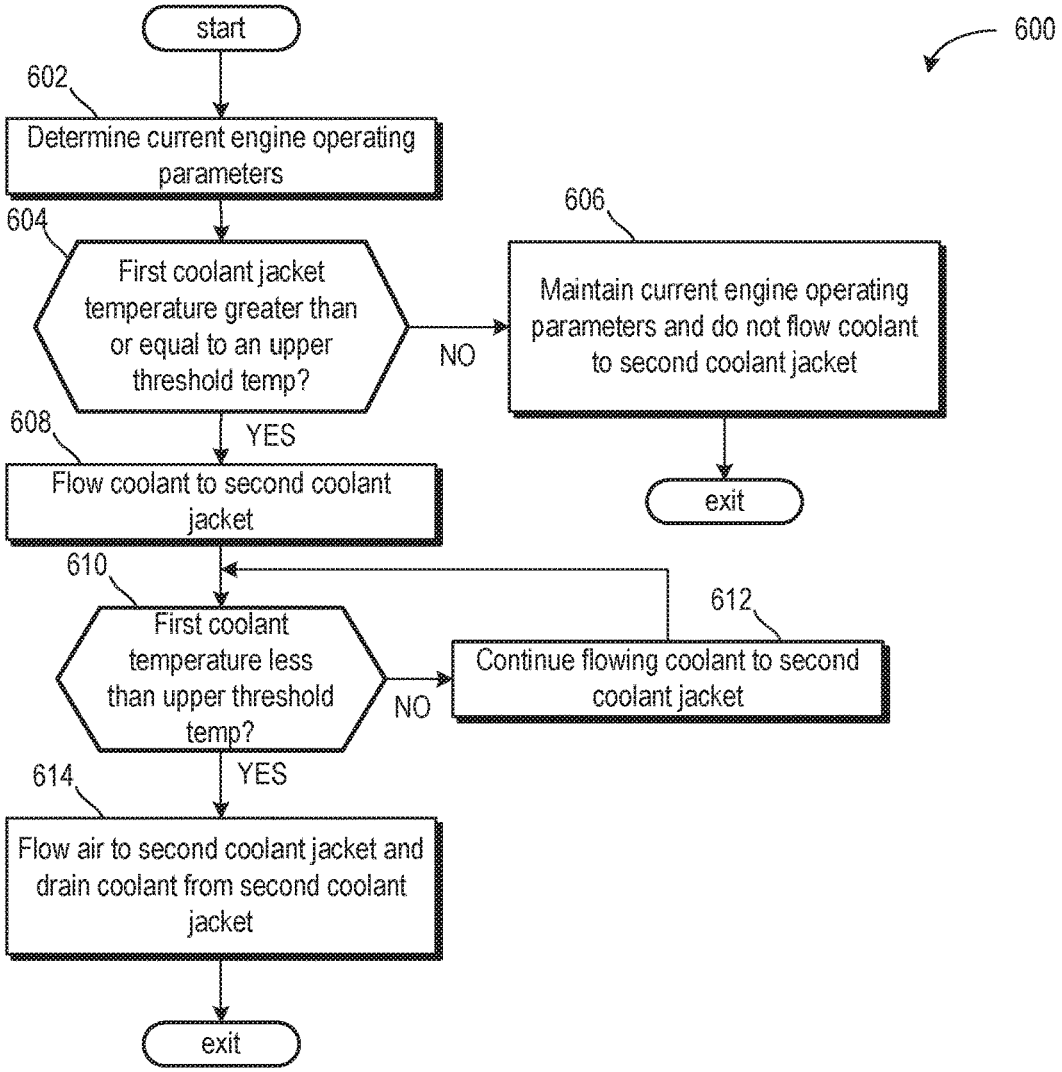
FIG. 6 shows a method for cooling coolant in a first coolant jacket by flowing coolant to a second coolant jacket.

Turning now to FIG. 6, it shows a method 600 adjusting a temperature of coolant in the first coolant jacket by flowing coolant to the second coolant jacket when EGR is enabled. As such, the coolant from the second coolant circuit may cool coolant from the first coolant circuit when EGR is flowing through the EGR cooler. As such, the method 600 is implemented when EGR is flowing and the second coolant jacket is filled with air.

The method 600 begins at 602, where the method determines, estimates, and/or measures current engine operating parameters. Current engine operating parameters may include, but is not limited to, one or more of an engine speed, engine temperature, vehicle speed, manifold pressure, EGR flow rate, and air/fuel ratio.

At 604, the method includes determining if a first coolant jacket temperature is greater than or equal to an upper threshold temperature. In one example, the upper threshold temperature is based on a coolant temperature where the coolant may begin to overheat (e.g., boil). If the first coolant jacket temperature is less than the upper threshold temperature, then the method proceeds to 606 to maintain current engine operating parameters and does not flow coolant from the second coolant circuit to the second coolant jacket. In this way, only the first coolant jacket of the EGR cooler is filled with coolant.

If the first coolant jacket temperature is greater than or equal to the upper threshold temperature, the coolant in the first coolant jacket is too hot. As such, the method proceeds to 608 to flow coolant from the second coolant circuit to the second coolant jacket. Since the coolant in the second coolant circuit has not been exposed to exhaust gas, its temperature is less than a temperature of coolant in the first coolant jacket. In this way, cool coolant from the second coolant circuit fills the second coolant jacket, where the second coolant jacket thermally communicates with coolant in the first coolant jacket and decreases a temperature of the first coolant jacket.

At 610, the method includes determining if the first coolant jacket temperature is less than the upper threshold temperature. If the first coolant jacket temperature is still greater than or equal to the upper threshold temperature, then the method proceeds to 612 to continue flowing coolant from the second coolant circuit to the second coolant jacket.

If the first coolant jacket temperature is less than the upper threshold temperature, then the method includes flowing air to the second coolant jacket and removing coolant from the second coolant jacket at 614. In this way, the coolant from the second coolant jacket is directed to one or more of a degas bottle and a radiator located along the second coolant circuit. Additionally, coolant in the second coolant circuit is thermally isolated from exhaust gas. By doing this, only coolant from the first coolant circuit may continue thermally communicating with exhaust gas.

Figure 7:
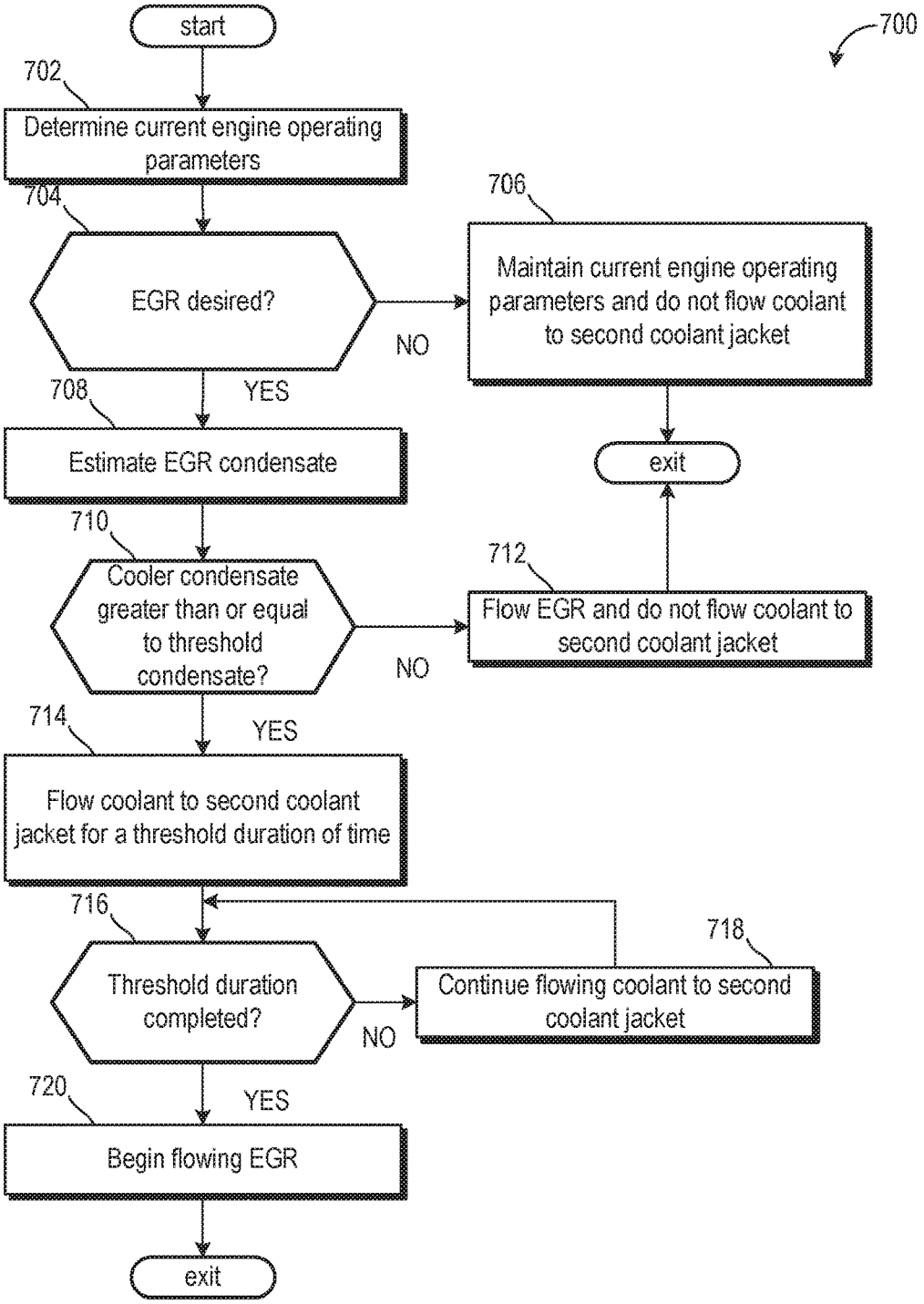
FIG. 7 shows a method for limiting condensate formation in the EGR cooler.
Figure 8:
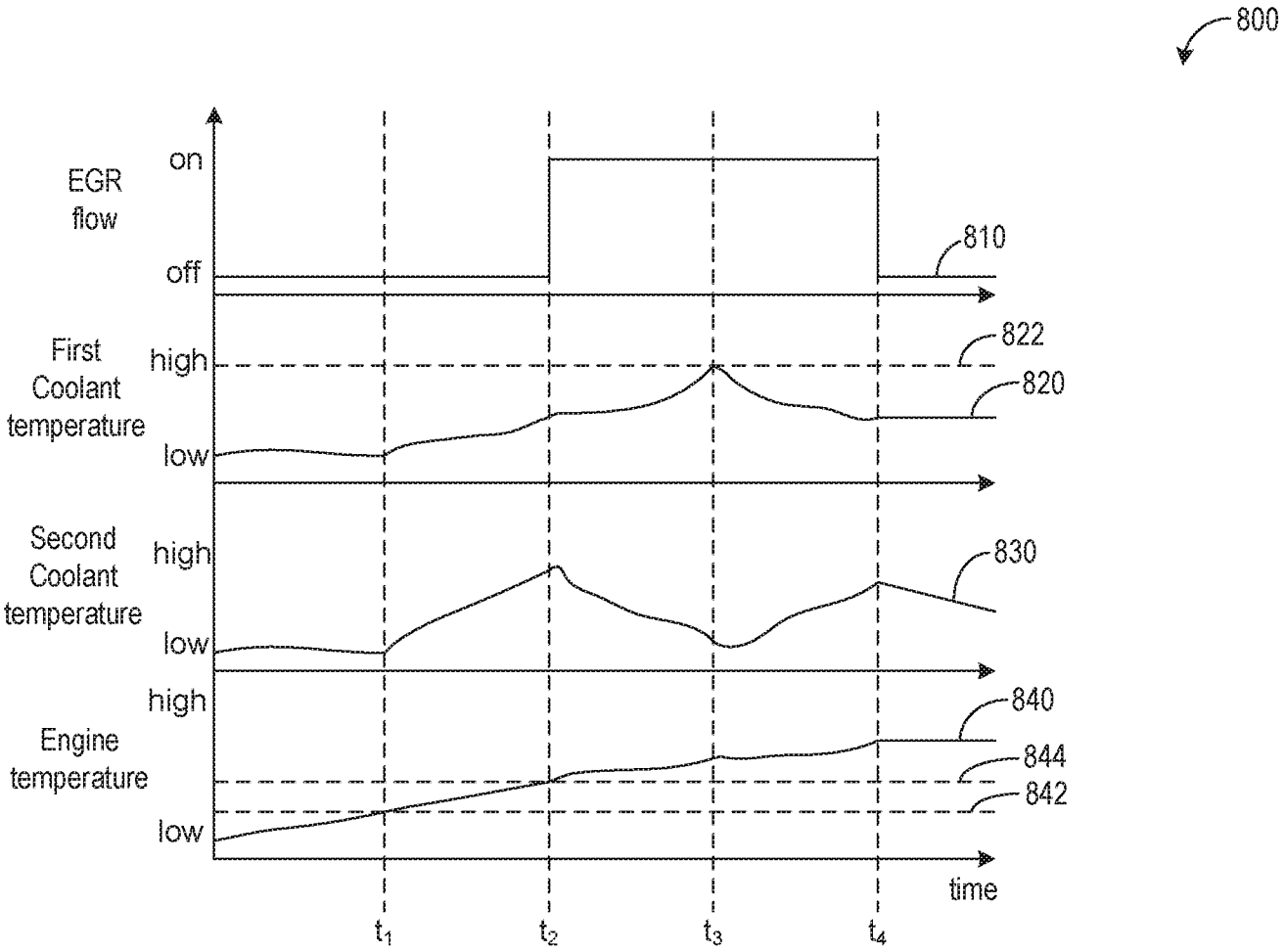
FIG. 8 shows an engine operating sequence illustrating one or more of the above methods using in conjunction with the EGR cooler and coolant jackets located therein.

Turning now to FIG. 7, it shows a method 700 for mitigating condensate formation in the EGR cooler. As an example, the second coolant circuit may flow coolant to the second coolant jacket prior to flowing EGR through the EGR cooler. This may heat surfaces of the EGR cooler, which may decrease a likelihood for condensate formation in the EGR cooler.

The method 700 begins at 702, where the method determines, estimates, and/or measures current engine operating parameters. Current engine operating parameters may include, but is not limited to, one or more of an engine speed, engine temperature, vehicle speed, manifold pressure, exhaust gas temperature, EGR flow rate, and air/fuel ratio.

At 704, the method includes determining if EGR is desired. In one example, EGR is desired if an engine temperature is approaching an upper threshold engine temperature, which may correspond with an engine temperature where degradation may occur and/or $NO_x$ emissions are greater than desired. If EGR is not desired, then the method proceeds to 706 to maintain current engine operating parameters and does not flow coolant from the second coolant circuit to the second coolant jacket of the EGR cooler.

If EGR is desired, then the method proceeds to 708 to estimate EGR condensate already present in the ERG cooler. This may include gathering data from a look-up table corresponding to EGR cooler temperatures, EGR flow rates, and EGR temperatures for previous engine conditions using EGR. In one example, an amount of condensate in the EGR cooler is tracked over time by estimating an amount of condensate likely to form in the EGR cooler subtracted by an amount of condensate swept out of the cooler by EGR. In one example, the amount of condensate likely to form in the EGR cooler increases when one or more of a water content of exhaust gas increases, when an exhaust gas temperature increases, and when an EGR cooler temperature decreases. Condensate in the EGR cooler may decrease as EGR continues to flow through the EGR cooler. The condensate is carried to the engine, which may decrease combustion stability if too much condensate is swept to the engine.

At 710, the method includes determining if the EGR cooler condensate is greater than or equal to a threshold condensate, wherein the threshold condensate correspond to an amount of condensate which may result in decreased combustion stability. If the EGR cooler condensate is less than the threshold condensate, then the method proceeds to 712 to flow EGR and does not flow coolant from the second coolant circuit to the second coolant jacket. In this way, an amount of condensate estimated to form in the EGR cooler, along with the amount of condensate already present in the EGR cooler, will not exceed the threshold condensate amount, and pre-heating of the EGR cooler is not needed.

If the cooler condensate is greater than or equal to the threshold condensate and condensate formed on during a subsequent EGR flow will inhibit engine efficiency, then the method proceeds to 714 to flow coolant from the second coolant circuit to the second coolant jacket for a threshold duration of time. In this way, the coolant in the second coolant jacket may be heated by exhaust gas in the exhaust gas passage prior to flowing EGR through the EGR cooler. This may allow the coolant in the first coolant jacket to warm-up, thereby increasing an EGR core temperature, which may mitigate condensate formation in the EGR cooler.

At 716, the method includes determining if the threshold duration is complete. The EGR cooler is pre-heated for a threshold duration of time. In one example, the threshold duration is a fixed duration (e.g., 20 seconds). In other examples, the threshold duration may be based on a difference between the amount of condensate present in the cooler and the threshold condensate, when the difference increases, the threshold duration increases. If the threshold duration is not complete, then the method proceeds to 718 to continue flowing coolant from the second coolant circuit to the second coolant jacket.

If the threshold duration is complete and the EGR cooler is sufficiently heated, then the method proceeds to 720 flow EGR through the EGR cooler. In some examples, the method may further include flowing air to the second coolant jacket, which results in coolant from the second coolant jacket flowing to one or more of a degas bottle and radiator of the second coolant circuit. Alternatively, coolant from the second coolant circuit may remain in the second coolant jacket.

Turning now to FIG. 8, it shows an operating sequence 800 graphically illustrating the methods 500 and 600 being implemented on the system 100 of FIG. 2 and EGR cooler 142 of FIGS. 2 and 3. Plot 810 illustrates a rate of EGR flow, plot 820 illustrates a first coolant temperature and line 822 illustrates an upper threshold coolant temperature, plot 830 illustrates a second coolant temperature, plot 840 illustrates an engine temperature, line 842 illustrates a threshold cold-start temperature, and line 844 illustrates a threshold friction temperature. Time increases from a left side of the figure to a right side of the figure. The first coolant temperature is indicative of a temperature of coolant in the first coolant jacket and the second coolant temperature is indicative of a temperature of coolant in the second coolant jacket.

Prior t1, a cold-start is occurring, as illustrated by the engine temperature being less than the threshold cold-start temperature (plots 840 and 842, respectively). As such, EGR flow is off, the first coolant temperature is low and the second coolant temperature is low.

At t1, the cold-start is complete as the engine temperature is greater than or equal to the threshold cold-start temperature. However, the engine temperature is less than the threshold friction temperature (line 844). This may indicate that engine oil is at a temperature less than a desired temperature and friction in the engine is greater than a desired amount. However, EGR may still be undesired at this point in the engine warm-up cycle. As such, coolant flows to the second coolant jacket by opening one or more valves. In the example of FIG. 1, one or more shut-off elements 7*a* and 7*c* are closed and one or more shut-off elements 7*b* and 7*d* are opened to allow coolant to flow to the second coolant jacket. In the example of FIG. 3, one or more of a degas inlet valve 344 and a radiator inlet line valve 352 are closed and one or more of the degas outlet valve 346 and radiator outlet line valve 354 are opened to flow coolant to the second coolant jacket. Additionally, coolant is delivered to the first coolant jacket when coolant from the second coolant circuit flows to the second coolant jacket. Coolant may flow to the first coolant jacket when at least a first coolant inlet line valve 318 and the first coolant outflow line valve 314 is closed, in the example of FIG. 3. As such, first coolant fills the first coolant jacket and second coolant fills the second coolant jacket. Exhaust gas does not flow through the EGR cooler, but is still able to heat the second coolant in the second coolant jacket. As the second coolant warms-up, it is able to heat up the first coolant in the first coolant jacket.

After t1 and prior to t2, the second coolant temperature continues to increase as exhaust gas flows by and thermally communicates with the second coolant jacket. The second coolant thermally communicates with the first coolant in the first coolant jacket, thereby increasing a temperature of the first coolant. The engine temperature continues to increase. This may be assisted by flowing the warm first coolant to the engine, where engine oil among other engine components (e.g., a cooling sleeve in a combustion chamber) are heated by the first coolant from the first coolant jacket. EGR remains off.

At t2, the engine temperature is substantially equal to threshold friction temperature. As such, second coolant is no longer delivered to the second coolant jacket. In one example, the second coolant jacket is filled with air. This may occur by one or more shut-off elements 7*a* and 7*c* being opened and one or more shut-off elements 7*b* and 7*d* being closed to allow air to flow to the second coolant jacket, in the example of FIG. 1. In the example of FIG. 3, one or more of a degas inlet valve 344 and a radiator inlet line valve 352 are opened and one or more of the degas outlet valve 346 and radiator outlet line valve 354 are closed to flow air to the second coolant jacket. In this way, the air in the second coolant jacket thermally insulates the first coolant jacket from exhaust gas in the exhaust passage. First coolant may continue to flow through the first coolant circuit since EGR is activated. In one example, EGR is demanded to decrease $NO_x$ emissions from the engine.

After t2 and prior to t3, EGR continues to flow through the EGR cooler, thereby increasing a temperature of the first coolant toward the upper threshold coolant temperature. The second coolant temperature continues to decrease as the second coolant remains in one or more of the degas bottle, radiator, and/or a container. The engine temperature continues to slightly increase, but at a rate less than a rate of temperature increase prior to t2. This may be due to the EGR flow.

At t3, the EGR continues to flow due to engine demand. As a result, the first coolant temperature exceeds the upper threshold coolant temperature. In response, the second coolant flows to the second coolant jacket. In this way, the second coolant may cool the first coolant and prevent the first coolant from boiling due to exposure to hot exhaust gas.

After t3 and prior to t4, the EGR remains active. The first coolant temperature begins to decrease to a temperature less than the upper threshold coolant temperature. The second coolant temperature begins to correspondingly increase as heat is transferred from the first coolant jacket to the second coolant jacket. As such, EGR continues to be cooled and flow to the engine without overheating of one or more of the coolants.

At t4, the EGR is deactivated in response to EGR demand being absent. As such, the first coolant may flow to other portions of the first coolant circuit (e.g., a combustion chamber cooling sleeve 114 of FIG. 2). The second coolant no longer flows to the second coolant jacket as the first coolant temperature is less than the upper threshold coolant temperature and exhaust heat energy is not demanded.

In this way, exhaust gas heat may be utilized without flowing exhaust gas through an EGR cooler. First and second coolant jackets of the EGR cooler are coupled to separate first and second coolant circuits, respectively. Additionally, the second coolant jacket contacts exhaust gas in the exhaust passage and serves as a barrier between the first coolant jacket and exhaust gas in the exhaust gas passage. The technical effect of thermally coupling the second coolant jacket to exhaust gas in the exhaust gas passage is to flow coolant from the second coolant circuit to the second coolant jacket when heating is desired and EGR is not. By doing this, engine efficiency may be increased.

An embodiment of a forced-induction internal combustion engine having at least one cylinder, an intake system for supplying the at least one cylinder with charge air, an exhaust system for discharging the exhaust gases, and an exhaust gas recirculation system, which has a recirculation line which, while forming a junction, branches off from the exhaust system and opens into the intake system, wherein a cooler is arranged in the recirculation line, which cooler has a core, which conducts coolant, is incorporated into a first coolant circuit and serves to transfer heat between the exhaust gas and the coolant, and where the cooler projects into the exhaust system in the region of the core, and at least one coolant jacket, which conducts coolant, is provided in the cooler, said jacket being arranged between the core conducting coolant and the exhaust system conducting exhaust gas and being incorporated into a second coolant circuit, wherein, to form the second coolant circuit, the at least one coolant jacket has a discharge line for discharging the coolant and a supply line for supplying the coolant. A first example of the engine further comprising where the coolant of the second coolant circuit is stored in a container, which is at least connectable to the at least one coolant jacket of the second coolant circuit via the discharge line and via the supply line. A second example of the engine, optionally including the first example, further includes where a bypass line for bypassing the container is provided, said bypass line branching off from the discharge line and opening into the supply line, and where the bypass line further comprises a heat exchanger. A third example of the engine, optionally including the first and/or second examples, further includes where the bypass line comprises a third shutoff element upstream of the heat exchanger and a fourth shutoff element downstream of the heat exchanger. A fourth example of the engine, optionally including one or more of the first through third examples, further includes where in the discharge line comprises a first shutoff element, the supply line comprises a second shutoff element, and where the second coolant circuit comprises a pump arranged in the discharge line. A fifth example of the engine, optionally including one or more of the first through fourth examples, further includes where the junction is located directly downstream of an aftertreatment device. A sixth example of the engine, optionally including one or more of the first through fifth examples, further includes where the aftertreatment device is one or more of a particulate filter, oxidation catalyst, and a combination thereof. A seventh example of the engine, optionally including one or more of the first through sixth examples, further includes where the exhaust gas recirculation system comprises a shutoff element, and where the shutoff element is located downstream of the cooler. A eighth example of the engine, optionally including one or more of the first through seventh examples, further includes where a bypass line for bypassing the cooler. A ninth example of the engine, optionally including one or more of the first through eighth examples, further includes where a controller with computer-readable instructions stored thereon that when executed enable the controller to flow coolant from a coolant circuit not coupled to the engine to at least one coolant jacket of the cooler during a warm-up phase of the engine.

An embodiment of a method, comprising flowing coolant from a first coolant circuit to a first coolant jacket of an exhaust gas recirculation cooler, flowing coolant from a second coolant circuit to a second coolant jacket of the exhaust gas recirculation cooler, and heating coolant in the first coolant jacket with coolant in the second coolant jacket when exhaust gas recirculation is deactivated. A first example of the method further includes where the first coolant circuit is fluidly coupled to an engine when a first coolant outflow valve is open and an engine inlet line valve is open. A second example of the method, optionally including the first example, further includes where flowing coolant from the second coolant circuit to the second coolant jacket occurs following a cold-start. A third example of the method, optionally including the first and/or second examples, further includes where flowing coolant from the second coolant circuit to the second coolant jacket occurs when a coolant temperature in the first coolant jacket is greater than or equal to an upper threshold temperature. A fourth example of the method, optionally including one or more of the first through third examples, further includes where flowing coolant from the second coolant circuit to the second coolant jacket occurs when an amount of condensate in an EGR cooler is greater than or equal to a threshold condensate amount.

An embodiment of a system comprising an EGR cooler arranged in an EGR passage, where the cooler comprises a first coolant jacket hermetically sealed from a second coolant jacket, and where a portion of the cooler comprising the second coolant jacket protrudes into a portion of an exhaust passage directly downstream of an aftertreatment device. A first example of the system further includes where the first coolant jacket is fluidly coupled to a first coolant circuit, the first coolant circuit being fluidly coupled to an engine, and where the second coolant jacket is fluidly coupled to a second coolant circuit. A second example of the system optionally including the first example further includes where the second coolant jacket is located between the exhaust passage and the first coolant jacket. A third example of the system, optionally including the first and/or second examples further includes where the second coolant jacket is in direct thermal communication with exhaust gas in the exhaust passage and where the first coolant jacket is in direct thermal communication with exhaust gas in the EGR cooler. A fourth example of the system, optionally including one or more of the first through third examples, further includes where a controller with computer-readable instructions that when executed enable the controller to flow coolant from the second coolant circuit to the second coolant jacket when EGR is not desired, and flow air from the second coolant circuit to the second coolant jacket when exhaust heat energy is not desired.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

flowing coolant from a first coolant circuit to a first coolant jacket of an exhaust gas recirculation (EGR) cooler;

flowing coolant from a second coolant circuit to a second coolant jacket of the exhaust gas recirculation cooler, the second coolant jacket extending into an exhaust passage downstream of an engine and positioned between the exhaust passage and the first coolant jacket; and heating coolant in the first coolant jacket with coolant in the second coolant jacket when exhaust gas recirculation is deactivated.

2. The method of claim 1, wherein the first coolant circuit is fluidly coupled to an engine when a first coolant outflow valve is open and an engine inlet line valve is open.

3. The method of claim 1, wherein flowing coolant from the second coolant circuit to the second coolant jacket occurs following a cold-start.

4. The method of claim 1, wherein flowing coolant from the second coolant circuit to the second coolant jacket occurs when a coolant temperature in the first coolant jacket is greater than or equal to an upper threshold temperature.

5. The method of claim 1, wherein flowing coolant from the second coolant circuit to the second coolant jacket occurs when an amount of condensate in the EGR cooler is greater than or equal to a threshold condensate amount.

6. The method of claim 1, wherein the first coolant jacket is within a core of the EGR cooler.

7. The method of claim 6, wherein the second coolant jacket surrounds an end of the core of the EGR cooler.

8. The method of claim 1, further comprising not activating EGR when coolant is in the second coolant jacket.

9. The method of claim 8, further comprising flowing coolant to the second coolant jacket when EGR is not desired.

10. The method of claim 1, further comprising flowing coolant to the second coolant jacket in response to a cold-start.

11. A system comprising:

an exhaust gas recirculation (EGR) cooler arranged in an EGR passage, where the EGR cooler comprises a first coolant jacket hermetically sealed from a second coolant jacket, wherein a portion of the EGR cooler comprising the second coolant jacket protrudes into a portion of an exhaust passage directly downstream of an aftertreatment device and an engine, and the second coolant jacket positioned between the exhaust passage and the first coolant jacket.

12. The system of claim 11, wherein the first coolant jacket is fluidly coupled to a first coolant circuit, the first coolant circuit being fluidly coupled to the engine, and where the second coolant jacket is fluidly coupled to a second coolant circuit.

13. The system of claim 11, wherein the second coolant jacket is located between the exhaust passage and the first coolant jacket.

14. The system of claim 11, wherein the second coolant jacket is in direct thermal communication with exhaust gas in the exhaust passage and where the first coolant jacket is in direct thermal communication with exhaust gas in the EGR cooler.

* * * * *